US010297954B2

(12) United States Patent
Tsai

(10) Patent No.: US 10,297,954 B2
(45) Date of Patent: May 21, 2019

(54) REVERSIBLE DUAL-POSITION ELECTRIC CONNECTOR AND METHOD OF ASSEMBLING THE SAME

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 15/512,354

(22) PCT Filed: Sep. 21, 2015

(86) PCT No.: PCT/CN2015/090131
§ 371 (c)(1),
(2) Date: Mar. 17, 2017

(87) PCT Pub. No.: WO2016/041527
PCT Pub. Date: Mar. 24, 2016

(65) Prior Publication Data

US 2017/0279226 A1 Sep. 28, 2017

(30) Foreign Application Priority Data

Sep. 19, 2014 (CN) ..... 2014 2 0541444 U
Sep. 30, 2014 (CN) ..... 2014 2 0573999 U
(Continued)

(51) Int. Cl.
*H01R 13/6581* (2011.01)
*H01R 13/502* (2006.01)
(Continued)

(52) U.S. Cl.
CPC ..... *H01R 13/6581* (2013.01); *H01R 13/502* (2013.01); *H01R 13/6658* (2013.01);
(Continued)

(58) Field of Classification Search
CPC ..... H01R 13/6594; H01R 13/6593; H01R 24/60; H01R 13/6581; H01R 13/502
See application file for complete search history.

(56) References Cited

U.S. PATENT DOCUMENTS 6,945,796 B2 * 9/2005 Bassler ..... H01R 12/724 439/101
6,981,887 B1 * 1/2006 Mese ..... H01R 29/00 439/244
(Continued)

FOREIGN PATENT DOCUMENTS

CN 201312013 Y 9/2009
CN 201956490 U 8/2011
(Continued)

OTHER PUBLICATIONS

National Intellectual Property Administration, PRC, "Office Action", dated Sep. 3, 2018.

*Primary Examiner* — Briggitte R. Hammond
(74) *Attorney, Agent, or Firm* — WPAT, PC

(57) ABSTRACT

A reversible dual-position electric connector comprises: an insulated seat provided with a base seat and one docking part, wherein the docking part is provided with two connection surfaces facing opposite directions; two terminal sets disposed on the insulated seat, wherein each of the terminal sets is provided with at least one row of terminals, and the contacts of the two terminal sets are exposed from the two connection surfaces of the docking part, respectively; and a metal housing, which covers the insulated seat and is provided with a four-sided primary housing; characterized in that a metal shell is further provided to rest against the metal housing, the metal shell is provided with a four-sided housing, the four-sided housing is fitted with and rests against the four-sided primary housing.

28 Claims, 27 Drawing Sheets

(30) Foreign Application Priority Data

| | | |
|---|---|---|
| Nov. 28, 2014 | (CN) | 2014 2 0735406 U |
| Dec. 31, 2014 | (CN) | 2014 2 0864997 U |
| Feb. 17, 2015 | (CN) | 2015 2 0113880 U |

(51) Int. Cl.

| | |
|---|---|
| ***H01R 24/60*** | (2011.01) |
| ***H01R 13/66*** | (2006.01) |
| *H01R 107/00* | (2006.01) |
| *H01R 13/64* | (2006.01) |

(52) U.S. Cl.
CPC ..... *H01R 24/60* (2013.01); *H01R 13/64* (2013.01); *H01R 2107/00* (2013.01)

(56) References Cited

U.S. PATENT DOCUMENTS

| | | | | |
|---|---|---|---|---|
| 7,363,947 | B2 * | 4/2008 | Teicher | H01R 27/00 139/173 |
| 7,553,172 | B2 * | 6/2009 | Chiu | H01R 13/64 439/131 |
| 7,717,717 | B1 * | 5/2010 | Lai | H01R 13/64 439/66 |
| 7,837,506 | B1 * | 11/2010 | Chiang | H01R 12/707 439/607.27 |
| 7,922,534 | B2 * | 4/2011 | Lin | H01R 13/64 439/544 |
| 8,052,467 | B1 * | 11/2011 | Xie | H01R 13/6594 439/589 |
| 8,073,985 | B1 * | 12/2011 | Ni | G06F 12/1416 439/660 |
| 8,840,321 | B2 * | 9/2014 | Wu | G02B 6/3817 385/89 |
| 2007/0077818 | A1 * | 4/2007 | Iwakawa | H01R 13/22 439/607.41 |
| 2007/0218762 | A1 * | 9/2007 | Liao | H01R 13/6456 439/607.01 |
| 2009/0209130 | A1 * | 8/2009 | Kameyama | H01R 23/6873 439/607.27 |
| 2012/0015561 | A1 * | 1/2012 | Tsai | H01R 24/60 439/660 |
| 2014/0099832 | A1 * | 4/2014 | Chang | H01R 13/6581 439/660 |
| 2014/0187105 | A1 * | 7/2014 | Zhao | H01R 12/707 439/733.1 |
| 2015/0229077 | A1 * | 8/2015 | Little | H01R 12/724 439/78 |

FOREIGN PATENT DOCUMENTS

| | | | |
|---|---|---|---|
| CN | 103904472 | A | 7/2014 |
| CN | 203707395 | U | 7/2014 |
| CN | 203800319 | U | 8/2014 |
| JP | 3126958 | B2 | 1/2001 |

* cited by examiner

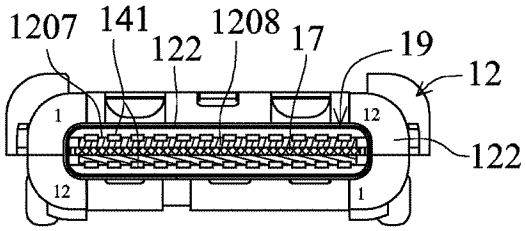
FIG. 19
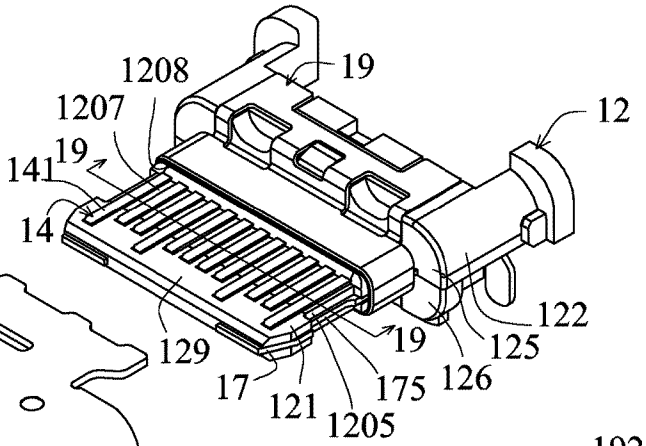
FIG. 20
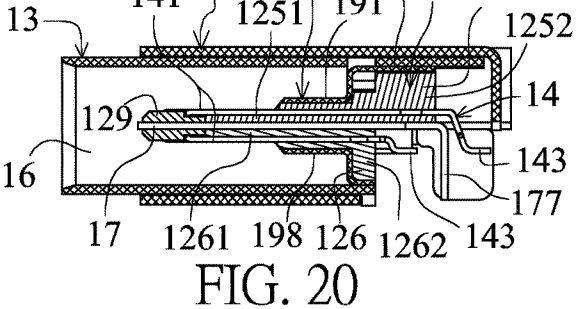
FIG. 17
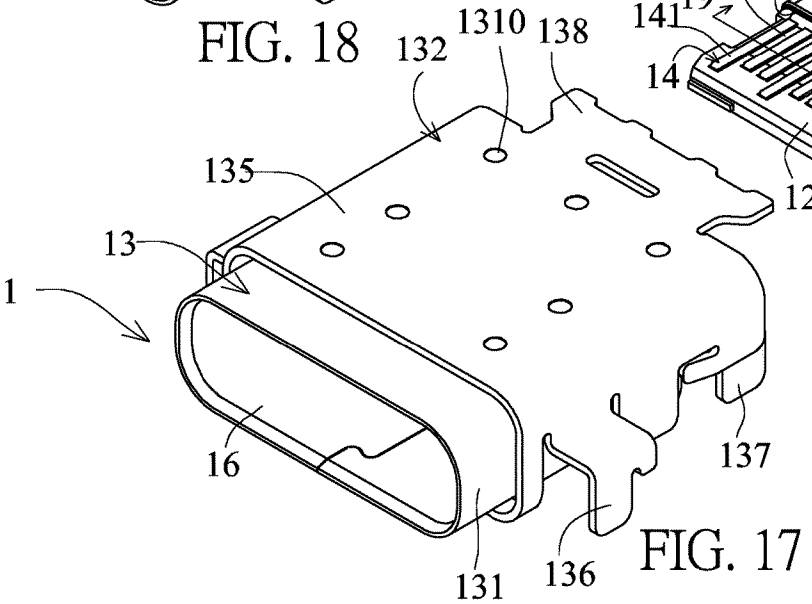
FIG. 18
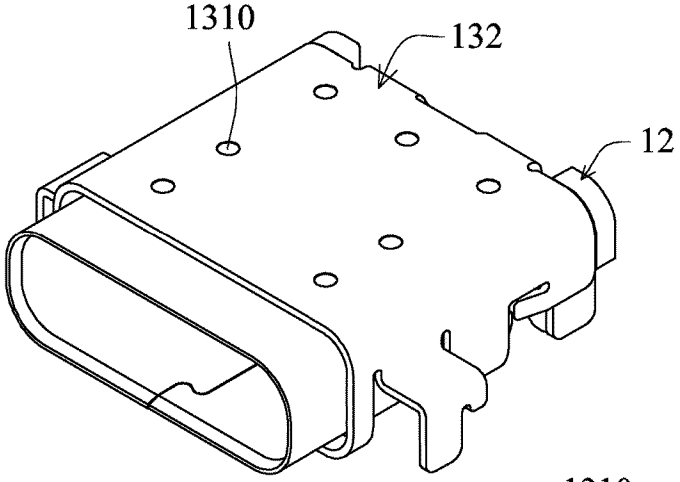

1221
1222
125
126
122
121
17
12
190
141
138
137
136
1318
1314
135
1315
132
275
13
134
139
133
131
1321
16
143
14
142
144

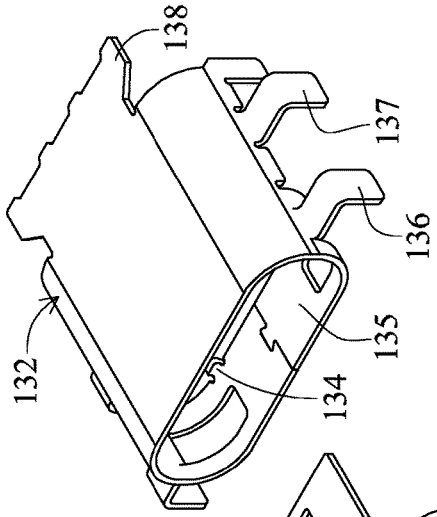
FIG. 43
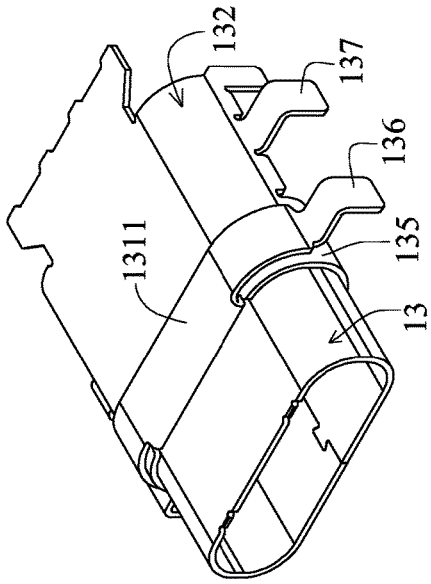
FIG. 45
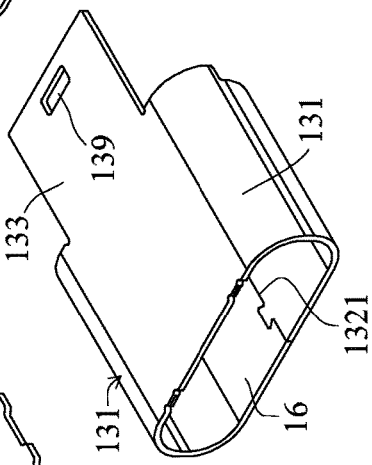
FIG. 44
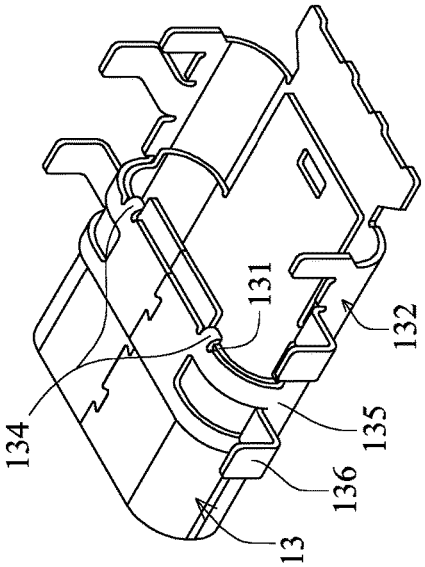
FIG. 42
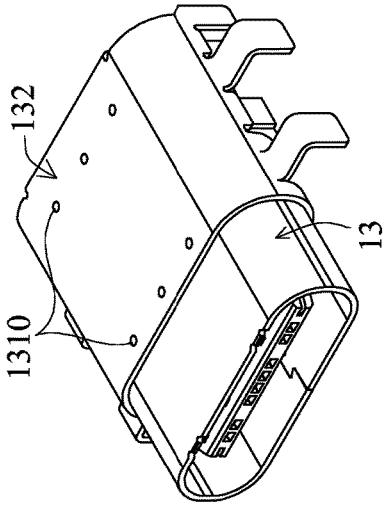

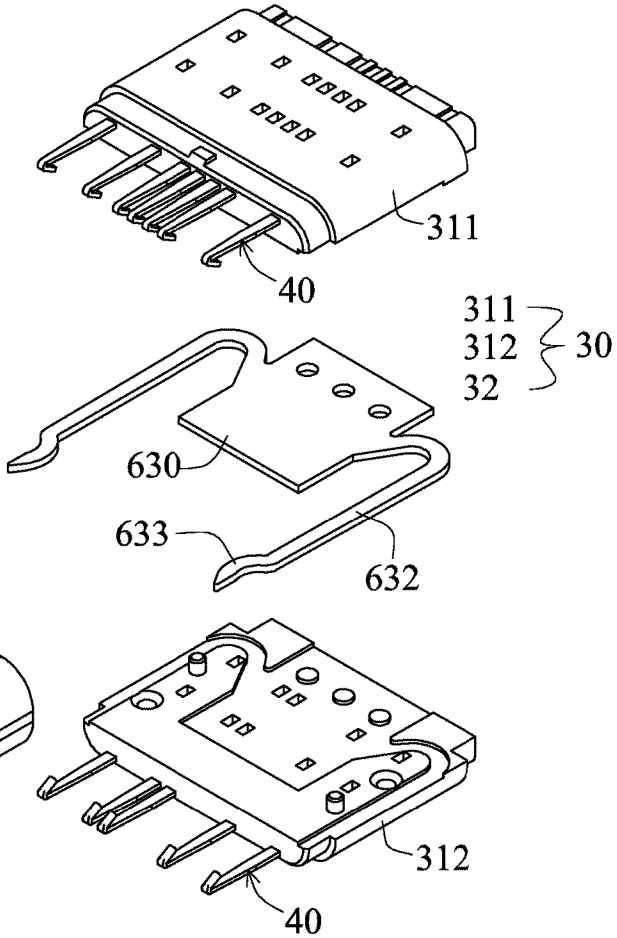
FIG. 84
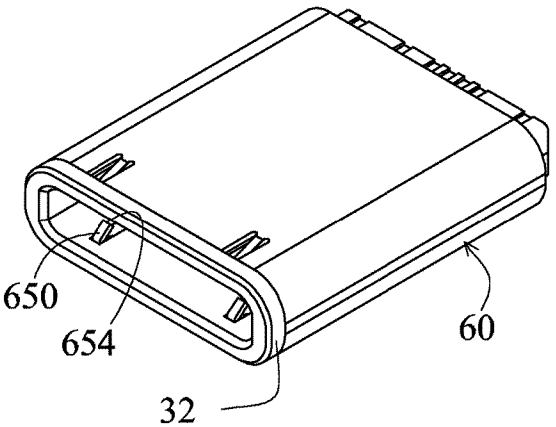
FIG. 85
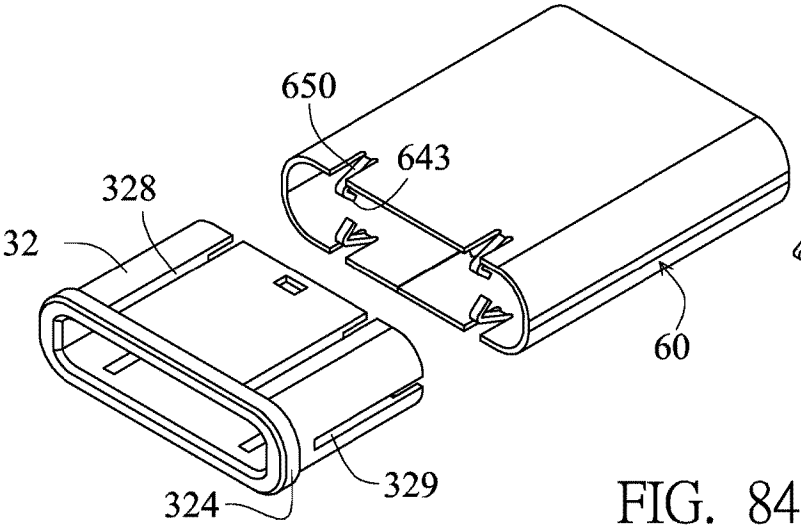

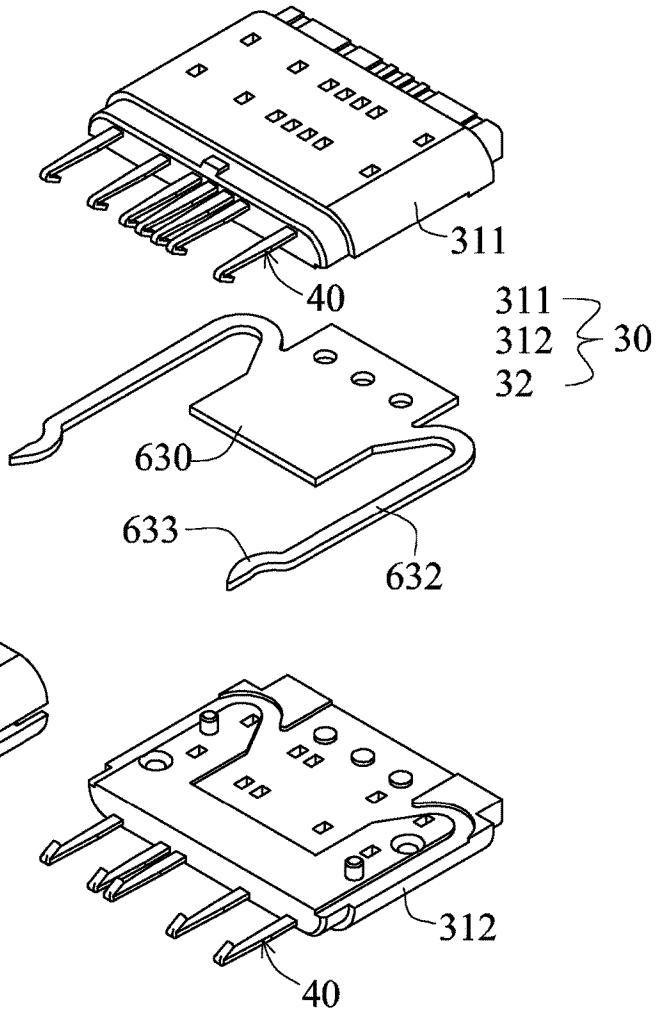
FIG. 86
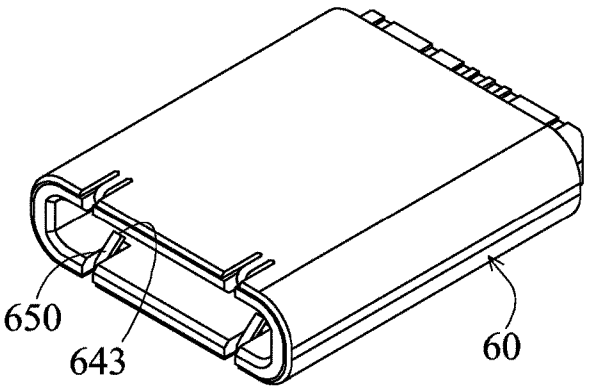
FIG. 87
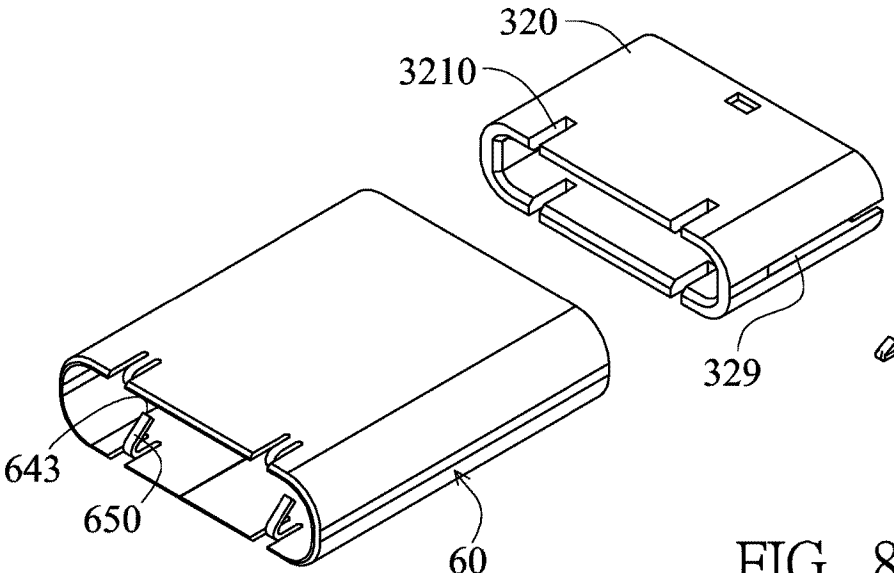

REVERSIBLE DUAL-POSITION ELECTRIC CONNECTOR AND METHOD OF ASSEMBLING THE SAME

BACKGROUND OF THE INVENTION

Field of the Invention

The invention relates to an electric connector, and more particularly to a reversible dual-position electric connector.

Description of the Related Art

Referring to FIGS. 1 and 2 showing a conventional high-definition multimedia interface (HDMI) electric connector comprising a plastic seat 91, two rows of terminals 92 and a metal housing 93, wherein the plastic seat 91 is integrally provided with a base seat 911 and a tongue 912, the tongue 912 projects beyond the front end of the base seat 911, the two rows of terminals 92 are embedded into the plastic seat 91, each of the two rows of terminals 92 are provided with an elastically non-movable contact 921 disposed on top and bottom surfaces of the tongue 912, respectively, and two rows of contacts 141 of the top and bottom surfaces of the tongue 912 respectively contain 10 and 9 contacts cross-interleaving in the left-to-right direction. The two rows of contacts 921 form the HDMI contact interface, the metal housing 93 covers the plastic seat 91, a front section inside the metal housing 93 is formed with a connection slot 95, the tongue 912 is horizontally disposed in the connection slot 95, and the shape of the connection slot 95 is asymmetrical in the top-to-bottom direction to provide the mistake-proof effect, so that the electrical connection can be made at one single position.

A conventional electrical connection socket cannot be easily manufactured because the two rows of terminals 92 are integrally embedded into the plastic seat 91. More particularly, when the specification becomes smaller, the manufacturing precision needs to be very high, and cannot be easily implemented.

Furthermore, the metal housing 93 is a four-sided housing bent from a metal plate sheet to have a seam to affect the shielding effect.

Moreover, the rear shielding shell of the conventional plug is formed by way of metal pulling and extending to form front and rear shielding shells fitting with each other in the front-to-rear direction, so that the manufacturing cost is so high.

Furthermore, the conventional socket and plug are provided with internal ground shielding sheets electrically connected together. However, the conventional socket and plug are provided with two separate ground shielding sheets, so that the assembling becomes more inconvenient and the effect of strengthening the overall structure cannot be provided.

SUMMARY OF THE INVENTION

A main object of the invention is to provide a reversible dual-position electric connector, which is provided with a metal shell fitting with a metal housing to possess the good shielding property and structural strength.

Another main object of the invention is to provide a reversible dual-position electric connector having a ground shielding member integrally provided with two ground shielding sheets and fitting with and positioned at the insulated seat, so that the convenience in manufacturing and assembling can be achieved.

Still another main object of the invention is to provide a reversible dual-position electric connector having a metal housing, which needs to possess the good shielding property and also can be stably positioned on a circuit board.

Yet still another main object of the invention is to provide a reversible dual-position electric connector, wherein the connection surface of the four-sided primary housing of the metal housing has a gapless combination to achieve the good shielding property.

Yet still another main object of the invention is to provide a reversible dual-position electric connector, wherein the connection surface of the four-sided primary housing of the metal housing has a seam, but most of the length of the seam is shielded to have the good shielding property.

A secondary object of the invention is to provide a reversible dual-position electric connector, which is provided with a metal shell fitting with metal housing, wherein the metal shell and the metal housing are formed by bending metal plate sheets with the same thickness, and have the same structural strength to support each other and mutually shield the seam, so that the endurances thereof are averaged, and the overall product is free from being scrapped due to the damage of the single part.

To achieve the above-identified objects, the invention provides a reversible dual-position electric connector, comprising: an insulated seat provided with a base seat and one docking part, wherein the docking part is disposed on one end of the base seat and is provided with two connection surfaces facing opposite directions; two terminal sets disposed on the insulated seat, wherein each of the terminal sets is provided with at least one row of terminals, each of the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure; characterized in that a metal shell is further provided to rest against the metal housing, the metal shell is provided with a four-sided housing, the four-sided housing is fitted with and rests against the four-sided primary housing, and one of the four-sided primary housing and the four-sided housing is a fully-closed housing without a prodding hole.

The invention further provides a reversible dual-position electric connector, comprising: an insulated seat provided with a base seat and one docking part, wherein the docking part is disposed on one end of the base seat and is provided with two connection surfaces facing opposite directions; two terminal sets disposed on the insulated seat, wherein each of the terminal sets is provided with at least one row of terminals, each of the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner; characterized in that the docking part is a tongue, the tongue is projectingly disposed on the end of the base seat, an inner end of the tongue is connected to the base seat, an outer end of the tongue is a free end, plate surfaces of the tongue with two larger areas are the two connection surfaces, the other two opposite sides of the tongue opposite to inner and outer ends are two sides, the metal housing and the base seat rest against and are positioned with each other, a connection slot is formed in the four-sided primary housing, the tongue is disposed at a middle height of the connection slot, the docking electric connector can be inserted and positioned into the connection slot in a dual-position bidirectional manner, and a ground shielding member resting against the metal housing is further provided, wherein the ground shielding member comprises two ground shielding sheets, each of which are provided by integrally bending a metal plate sheet to form a gap between the two ground shielding sheets, the two ground shielding sheets are provided with first plate sheets covering two inner sections of the two connection surfaces of the tongue, respectively, at least one ground shielding sheet is provided with a second plate sheet forming a step together with the first plate sheet, the second plate sheet covers the base seat and is electrically connected to the metal housing, and the second plate sheet has no resilient convex portion resiliently resting against the metal housing.

The invention further provides a reversible dual-position electric connector, comprising: an insulated seat provided with a base seat and one docking part, wherein the docking part is disposed on one end of the base seat and is provided with two connection surfaces facing opposite directions; two terminal sets disposed on the insulated seat, wherein each of the terminal sets is provided with at least one row of terminals, each of the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner; characterized in that the docking part is provided with two connection plates facing each other in a top-to-bottom direction, a connection slot is formed between the two connection plates, opposite surfaces of the two connection plates are the two connection surfaces, and a ground shielding member resting against an inside of the metal housing is further provided, wherein the ground shielding member comprises two ground shielding sheets integrally provided with a gap between the two ground shielding sheets, the two ground shielding sheets are provided with at least two resilient contacts shielding outsides of the two connection plates, respectively, and the contacts of the two ground shielding sheets project beyond the two connection surfaces, respectively.

The invention further provides a reversible dual-position electric connector, comprising: an insulated seat provided with a base seat and one docking part, wherein the docking part is disposed on one end of the base seat and is provided with two connection surfaces facing opposite directions; two terminal sets disposed on the insulated seat, wherein each of the terminal sets is provided with at least one row of terminals, each of the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner; characterized in that the metal housing is formed by bending a metal plate sheet, the four-sided primary housing is combined and locked together on a plate surface, and a combination portion forms a gapless combination.

The invention further provides a reversible dual-position electric connector, comprising: an insulated seat provided with a base seat and one docking part, wherein the docking part is disposed on one end of the base seat and is provided with two connection surfaces facing opposite directions; two terminal sets disposed on the insulated seat, wherein each of the terminal sets is provided with at least one row of terminals, each of the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner; characterized in that the docking part is a tongue, the tongue is projectingly disposed on the end of the base seat, an inner end of the tongue is connected to the base seat, an outer end of the tongue is a free end, plate surfaces of the tongue with two larger areas are the two connection surfaces, the other two opposite sides of the tongue opposite to the inner and outer ends are two sides, the metal housing and the base seat rest against and are positioned with each other, a connection slot is formed in the four-sided primary housing, the tongue is disposed at a middle height of the connection slot, the docking electric connector can be inserted and positioned into the connection slot in a dual-position bidirectional manner, the metal housing is integrally provided with a reversely bent plate, the reversely bent plate is stacked outside a top surface of the four-sided primary housing, the reversely bent plate integrally extends downwardly to provide at least one first plate connecting member disposed on left and right sides of the four-sided primary housing, and the first plate connecting member can be connected to and positioned on a circuit board.

The invention further provides a reversible dual-position electric connector, comprising: an insulated seat provided with a base seat and one docking part, wherein the docking part is disposed on one end of the base seat and is provided with two connection surfaces facing opposite directions; two terminal sets disposed on the insulated seat, wherein each of the terminal sets is provided with at least one row of terminals, each of the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner; characterized in that the docking part is a tongue, the tongue is projectingly disposed on the end of the base seat, an inner end of the tongue is connected to the base seat, an outer end of the tongue is a free end, plate surfaces of the tongue with two larger areas are the two connection surfaces, the other two opposite sides of the tongue opposite to the inner and outer ends are two sides, the metal housing and the base seat rest against and are positioned with each other, a connection slot is formed in the four-sided primary housing, the tongue is disposed at a middle height of the connection slot, the docking electric connector can be inserted and positioned into the connection slot in a dual-position bidirectional manner, the metal housing integrally provided with one or multiple reversely bent plates, and the one or multiple reversely bent plates are stacked on top and bottom plate surfaces of the metal housing.

The invention can be generalized to have the following advantages.

1. The metal housing is provided with first and second plate connecting members, arranged in front and back thereof, and can be stably positioned on a circuit board. In addition, the four-sided primary housing has no prodding hole to have the good shielding property, and to achieve the smaller electromagnetic compatibility coverage and electromagnetic interference (EMI) and the good electromagnetic susceptibility (EMS).

2. The metal housing is assembled and filled with the metal housing through the metal shell to possess the good shielding property and also to be stably positioned on the circuit board, and can be easily manufactured and machined.

3. The metal housing uses the integrally provided with reversely bent sheet to achieve to possess the good shielding property and also to be stably positioned on the circuit board, and can be easily manufactured and machined.

4. The connection surface of the four-sided primary housing is the gapless combination to have the good shielding property.

5. Although the connection surface of the four-sided primary housing has the seam, most of the length of the seam is shielded to have the good shielding property.

6. A metal shell fitting with metal housing to possess the good shielding property and structural strength is provided.

7. The ground shielding member is integrally provided with two ground shielding sheets and fitted with and positioned at the insulated seat, so that the convenience in manufacturing and assembling can be achieved.

8. A metal shell fitting with metal housing is provided. The metal shell and the metal housing are formed by bending the metal plate sheet with the same thickness, and have the same structural strength can support each other and mutually shield the seam, so that the endurances thereof are averaged, and the overall product is free from being scrapped due to the damage of the single part.

The above-mentioned and other objects, advantages and features of the invention will become more fully understood from the detailed description of the preferred embodiments given hereinbelow and the accompanying drawings.

BRIEF DESCRIPTION OF THE DRAWINGS

FIG. 17 is a pictorially exploded view according to socket of the first embodiment of the invention.

FIG. 18 is a pictorially assembled view according to socket of the first embodiment of the invention.

FIG. 19 is a front view according to socket of the first embodiment of the invention (when the metal housing is not assembled).

FIG. 20 is a side cross-sectional view according to socket of the first embodiment of the invention.

FIG. 42 is a pictorial view showing another implementation state according to the sixth embodiment of the invention.

FIG. 43 is a stereoscopic exploded view showing the metal housing and the metal shell according to the seventh embodiment of the invention.

FIG. 44 is a pictorially assembled view showing the metal housing and the metal shell according to the seventh embodiment of the invention.

FIG. 45 is a pictorially assembled view showing the metal housing and the metal shell according to the eighth embodiment of the invention.

FIG. 84 is a stereoscopic exploded view according to the 32nd embodiment of the invention.

FIG. 85 is a pictorially assembled view according to the 32nd embodiment of the invention.

FIG. 86 is a stereoscopic exploded view according to the 33rd embodiment of the invention.

FIG. 87 is a pictorially assembled view according to the 33rd embodiment of the invention.

DETAILED DESCRIPTION OF THE INVENTION

Figure 2:
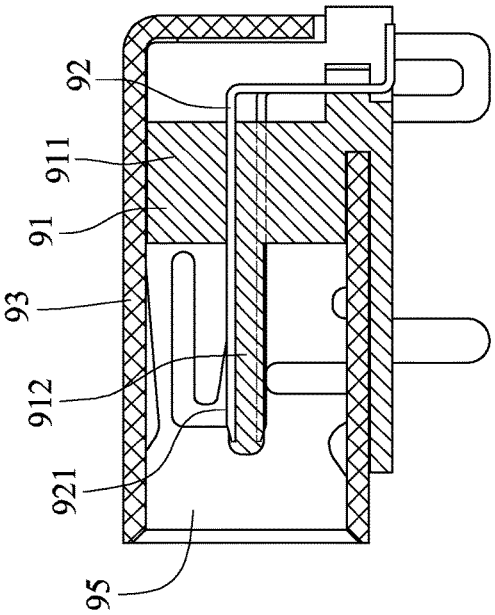
FIG. 2 (Prior Art)
FIG. 2 is a side cross-sectional view showing the conventional electric connector.
Figure 1:
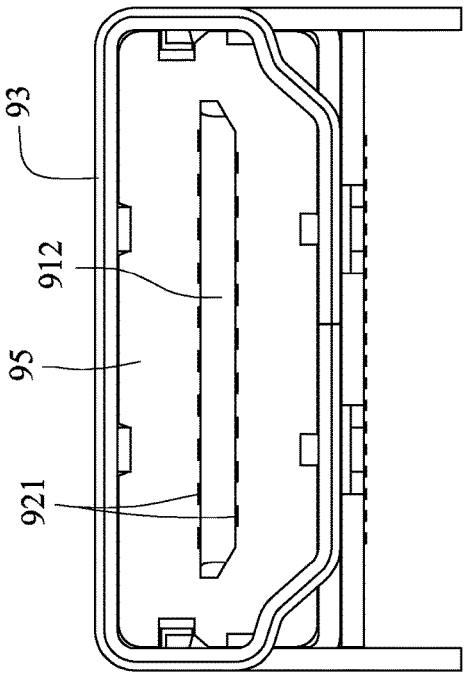
FIG. 1 (Prior Art)
FIG. 1 is a front view showing a conventional electric connector.

Referring to FIGS. 3 to 31, the first embodiment of the invention is a bidirectional duplex USB TYPE-C electrical connection socket 1 and a bidirectional duplex USB TYPE-C electrical connection plug 2 mutually docking with each other.

Referring to FIGS. 4 to 13, the bidirectional duplex USB TYPE-C electrical connection plug 2 of this embodiment is provided with an insulated seat 30, two terminal sets, a metal housing 60, a metal partition plate 630, a ground shielding member 640, a circuit board 200 and a rear shielding shell 400.

Referring to FIGS. 4, 6, 10 and 11, the insulated seat 30 is provided with a base seat 31 and a docking part 32.

The base seat 31 is provided with a first base seat 311 and a second base seat 312 directly stacked vertically. The rear section of the base seat 31 is higher and wider than the front section thereof. The front end of the base seat is provided with a jointing portion 304. Two sides of the jointing portion 304 are provided with frontward projecting and arced side portions with a notch formed therebetween. Each of the top and bottom surfaces of the middle section of the jointing portion 304 is provided with an engagement block 307. Each of the top and bottom surfaces of the front section of the base seat 31 is provided with two engagement blocks 36. Two sides 313 of the rear section of the base seat 31 backward project so that a middle of the rear section of the base seat 31 is formed with a notch 314. Two sides of the base seat 31 are provided with a fitting slot 315. Each of the jointing surfaces of the first and second base seats 311 and 312 is provided with a concave surface 317.

The docking part 32 is a fitting member, which is a fitting frame body having a flat and long shape and two arced sides and approaching a rectangle. The docking part 32 is provided with two connection plates 320 facing each other in a top-to-bottom direction and having the same height, and has two side plates connected to the two connection plates 320 to form a fitting frame body, so that the front end of the docking part 32 is an inserting port, and the rear end of the docking part 32 is a fitting port. The opposite surfaces of the two connection plates 320 are two connection surfaces 323 facing opposite directions. A connection slot 325 is formed between the two connection surfaces 323. Each of rear sections of the inner surfaces of the two connection plates 320 is provided with one row of separate barriers to separate the space into one row of slots 322. The opposite surfaces of two rows of barriers 322 are rear sections of the two connection surfaces 323. So, the two connection surfaces 323 have the front sections lower than the rear sections, so that the connection slot 325 forms the front section higher than the rear section in the height direction. Each of the portions near the middles of the rear ends of the two connection plates 320 is provided with an engagement hole 321 and has a front end provided with three openings 328, and two side plates provided with an opening 329.

The fitting port of the rear end of the docking part 32 is fitted with the jointing portion 304 of the base seat 31. The jointing portion 304, and the engagement hole 321, the engagement block 307.

Figure 7:
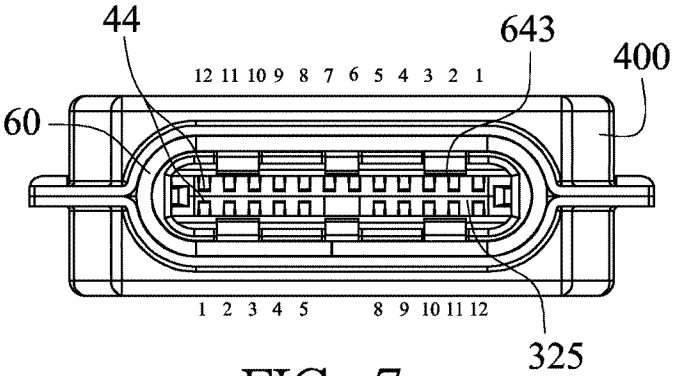
FIG. 7 is a front view according to plug of the first embodiment of the invention.
Figures 10, 11, 12:
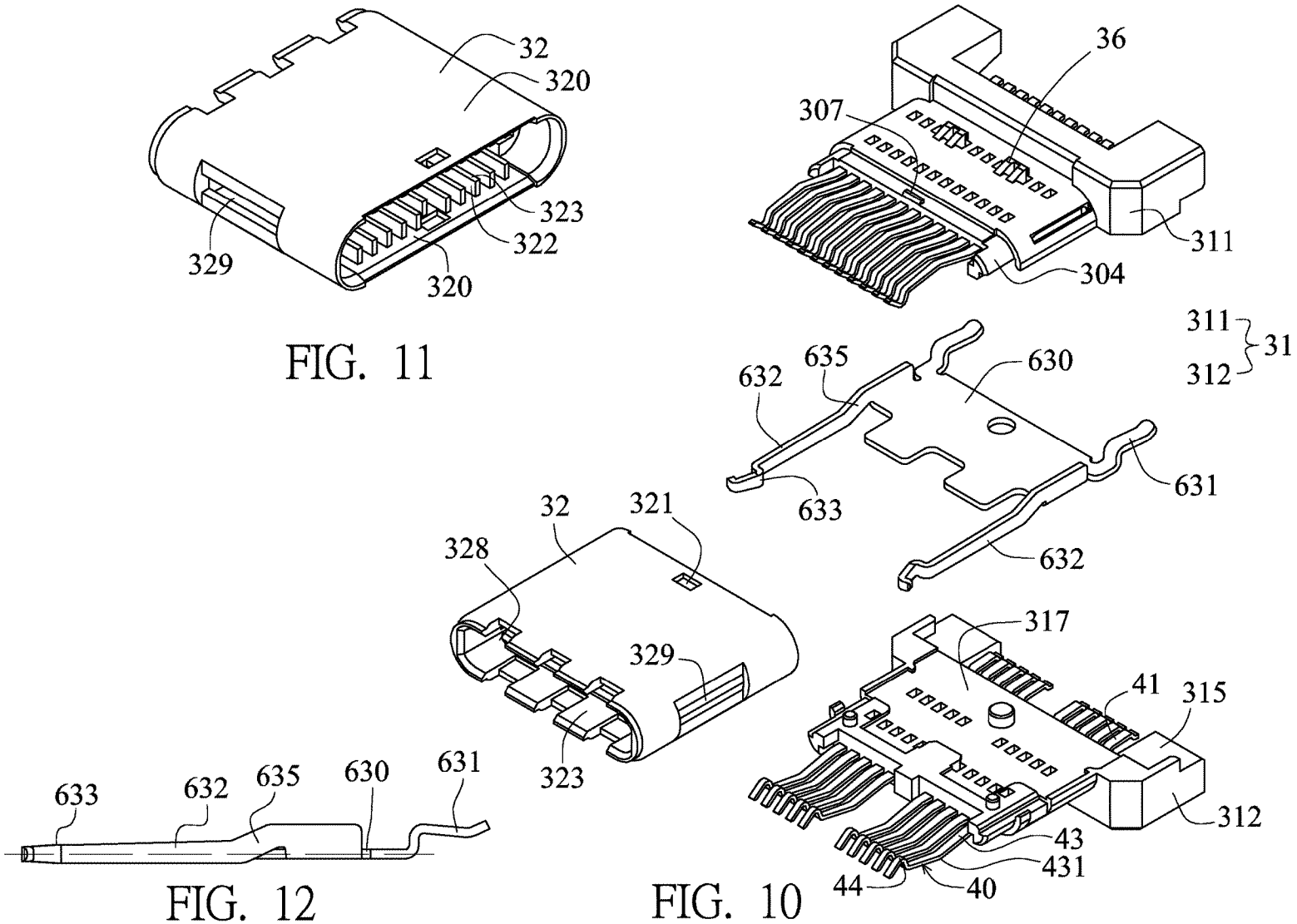
FIG. 10 is a pictorially exploded view showing the insulated seat and a metal partition plate according to plug of the first embodiment of the invention.
FIG. 11 is a pictorial view showing a docking part according to plug of the first embodiment of the invention.
FIG. 12 is a side view showing the metal partition plate according to plug of the first embodiment of the invention.

The two terminal sets include one row of 12 first terminals 40 fixedly embedded into and injected molded with the first base seat 311, and one row of 10 first terminals 40 fixedly embedded into and injected molded with the first base seat 311. Each first terminal 40 is sequentially provided with, from one end to the other end, a pin 41, a fixing portion 42 and an extension 43. The fixing portion 42 is fixed to the base seat 31. The extension 43 is connected to the front end of the fixing portion 42, extends to the position in front of the base seat 31, is covered by the docking part 32, and is vertically elastically movable in the slot 322. A portion of the extension 43 near the front end of the extension 43 is curved and projectingly provided with a contact 44. The contact 44 projects from the rear section of the connection surface 323 to the connection slot 325. The middle section of the extension 43 is provided with a fulcrum 431 resting against the connection plate 320. The pin 41 is connected to the rear end of the fixing portion 42 and extends out of the rear end of the base seat 31, and the contacts of the two rows of first terminals 40 with the same circuit serial numbers are arranged reversely, as shown in FIG. 7. The contacts 44 of the lower terminal set have the connection points with the circuit serial numbers arranged as 1, 2, 3, . . . , 11, 12 from left to right, and the contacts 44 of the lower terminal set have the connection points with the circuit serial numbers arranged as 12, 11, . . . , 3, 2, 1 from left to right. The lower terminal set has 10 terminals, and lacks the terminal with the contacts having the connection points with the circuit serial numbers of 6 and 7.

The contacts of the two terminal sets are vertically aligned, and the contacts of the two terminal sets are arranged in an equally spaced manner.

The fulcrums 431 of the extensions 43 of the two rows of first terminals 40 rest against the connection plate 320, so that the elastically movable arm of force has the high structural strength and the good resilience, and the contact 44 has the larger normal force.

The metal partition plate 630 is assembled on the concave surface 317 of the jointing surface between the first and second base seats 311 and 312 and positioned between the first and second base seats 311 and 312 and in the exact middle of the base seat 31 to separate the two terminal sets. Each of the left and right sides of the metal partition plate 630 integrally extends backwards to form a pin 631, and integrally extends frontwards to form a resilient snap 632. The portions of the resilient snaps near the front ends of the resilient snaps are provided with two snapping convex portions 633 disposed on the left and right sides of the connection slot 325. The height of the snapping convex portion 633 is greater than the material thickness of the metal partition plate 630, and the snapping convex portion 633 is substantially disposed at the middle height of the connection slot 325. When the two resilient snaps 632 elastically move in the left-right direction, the openings 329 on the two sides of the docking part 32 may provide the spaces for the two resilient snaps 632. The rear end of the resilient snap 632 has a plate surface vertically connected to the metal partition plate 630, and the rear section of the resilient snap 632 is provided with a bent portion 635 so that a vertical step is formed between the front section and the rear end, and the middle height of the snapping convex portion 633 is substantially disposed at the middle thickness of the metal partition plate 630.

The ground shielding member 640 has a four-sided housing 642 to form a metal shell. The four-sided housing is a four-sided cover formed by bending a metal plate sheet and provides one side for combination and engagement to form a seam 647. The four-sided housing 642 has four plate surfaces 642*a* integrally connected together, and the four plate surfaces 642*a* shielding the docking part 32 has no prodding hole facing the docking part 32. The top and bottom plate sheets of the four-sided housing are two ground shielding sheets 641. Each of the rear sections of the two ground shielding sheets 641 is provided with two ribs 649 and two engagement holes 644, and each of the front ends of the two ground shielding sheets 641 is bent inwardly and reversely to form three elastic sheets. Each of the three elastic sheets is curved and projects to form a contact 643. The ground shielding member 640 is fitted with and rests against the front section of the base seat 31 and the docking part 32 of the insulated seat 30. The engagement hole 644 is engaged with the engagement block 36. The contacts 643 of the two ground shielding sheets 641 project from an opening 28 of the docking part 32 to the front sections of the two connection surfaces 323. The contacts of the two terminal sets 44 are respectively exposed from the rear sections of the two connection surfaces 323 and are closer to the middle height of the connection slot 325 than the contacts 643 of the two ground shielding sheets 641.

The metal housing 60 covers the insulated seat 30 and the ground shielding member 640. The metal housing 60 is formed by bending a metal plate sheet and is integrally provided with a four-sided primary housing 61 and a convex shell 612. The convex shell 612 is connected to the rear end of the four-sided primary housing 61, and projects beyond the four-sided primary housing 61 in the top-bottom direction and the left-right direction. The four-sided primary housing 61 is combined and engaged together on a plate surface to form a seam 616. The four-sided primary housing 61 has four plate surfaces 61*a* integrally connected together, and the four plate surfaces 61*a* shielding the docking part 32 have no prodding hole facing the docking part 32. The four-sided primary housing 61 is top-bottom symmetrical and left-right symmetrical. The four-sided primary housing 61 shields the docking part 32 to form a docking structure 75. The shape of the docking structure 75 may be reversibly positioned in a docking electric connector at two positions. The convex shell 612 covers the rear section of the base seat 31 and has left and right sides each provided with a fitting slot 615 corresponding to the fitting slot 315 of the insulated seat 30. The top and bottom plates of the rear section of the four-sided primary housing 61 are provided with two engagement holes 62. The engagement hole 62 is engaged with the engagement block 36. The ground shielding member 640 has a four-sided housing to form a metal shell, which is fitted with and rests against and inside the metal housing 60. A rib 649 can ensure the tight contact with the metal housing 60. A front edge 618 of the metal housing 60 is bent inwardly and stopped at the front edge of the ground shielding member 640.

The seam 616 of the metal housing 60 and the seam 647 of the ground shielding member 640 are disposed on the bottom plate surface, but are staggered in the left-right direction so that the two housings can mutually shield the seams. Because the four plate surfaces 61*a* of the four-sided primary housing 61 and the four plate surfaces 642*a* of the four-sided housing 642 have no prodding hole facing the docking part 32, the better shielding effect can be provided to the docking part 32, and the better electrical effect can be obtained.

In addition, the seam 616 of the metal housing 60 and the seam 647 of the ground shielding member 640 may also be implemented as being disposed on the top plate surface and the bottom plate surface, respectively, so that the two housings can mutually shield the seams to reinforce the structure.

Furthermore, the seam 616 of the metal housing 60 and the seam 647 of the ground shielding member 640 may also implemented by way of laser welding and hot melting combination so that the combination portions have no gap.

Referring to FIGS. 4, 6, 8 and 9, the circuit board 200 is a printed circuit board (PCB). Each of the front and rear ends of the top surface of the PCB is provided with one row of connection points 206 and 208 with circuit connections, and each of the front and rear ends of the bottom surface of the PCB is provided with one row of connection points 206 with circuit connections. Each of the left and right sides of the top and bottom surfaces is provided with a wear-resistant pad 209. The left and right sides of the circuit board 200 are snapped to the fitting slots 315 and 615, and the wear-resistant pad 209 may rest against the metal fitting slot 615. The pins 41 of the two terminal sets are respectively bonded to one row of connection points 206 of the front ends of the top and bottom surfaces, and the two pins 631 of the metal partition plate 630 are bonded to the two connection points 208 of the front end of the top surface.

The rear shielding shell 400 is made of a metal material and covers the rear section of the metal housing 60, the rear section of the insulated seat 30 and the circuit board 200. The rear shielding shell 400 is formed with an accommodating space 410 thereinside, and has front and rear ends each provided with fitting ports 404 and 405. The fitting port 404 is fitted with the rear section of the four-sided primary housing 61 of the metal housing. The heights of the fitting ports 404 and 405 are lower than that of the accommodating space 410. The rear shielding shell 400 is composed of two housings 401 vertically combined together. Each of the two housings 401 is provided with a seamless chamber 402. The periphery of the chamber 402 is provided with a combination plate 403. The combination plates 403 of the two housings 401 are vertically combined together. The chambers 402 of the two housings face each other to form the accommodating space 410, wherein the combination plate 403 of one housing 401 is provided with snapping sheets 406 snapping to the combination plate 403 of the other housing 401.

The chambers 402 of the tow housings 401 are formed of metal sheets by way of drawing extension molding, are formed by way of metal die casting, or are formed by way of metal powder injection molding.

Figure 13:
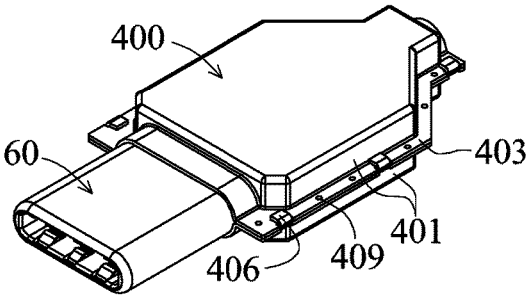
FIG. 13 is a diagram showing the implemented state according to plug of the first embodiment of the invention.
Figure 14:
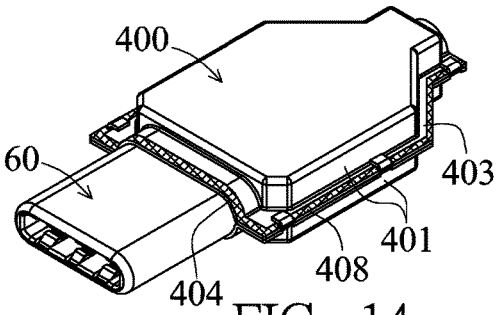
FIG. 14 is a diagram showing the implemented state according to plug of the first embodiment of the invention.

Referring to FIG. 13 upon implementation, the combination plates 403 of the two housings 401 are further formed with the spot welding 409. Referring to FIG. 14, the combination plates 403 of the two housings 401 and the fitting port 404 may further be formed with the laser welding 408 (hatched portion) to implement the hot melting combination so that the combination portion is formed with the seamless combination.

Figure 14A:
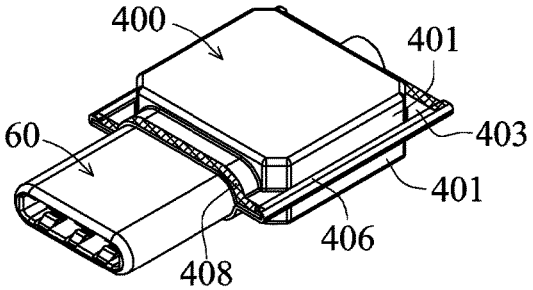
FIG. 14A is a diagram showing the implemented state according to plug of the first embodiment of the invention.
Figure 14B:
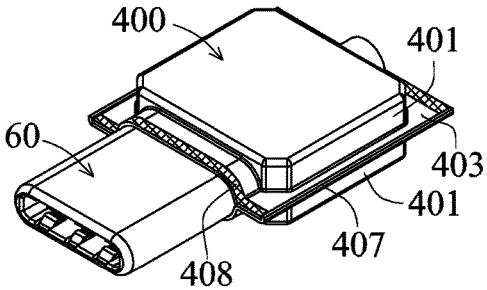
FIG. 14B is a diagram showing the implemented state according to plug of the first embodiment of the invention.
Figure 14C:
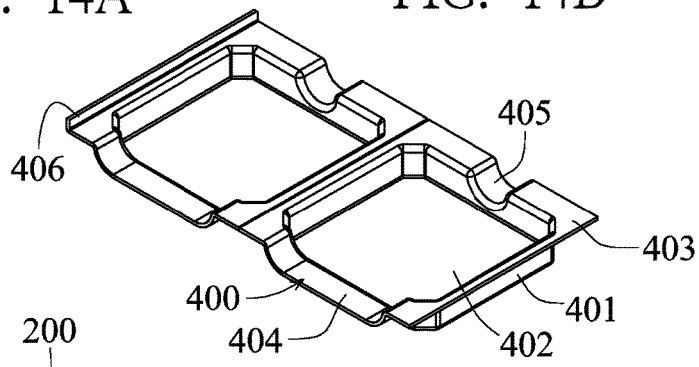
FIG. 14C is a diagram showing the implemented state according to plug of the first embodiment of the invention.
Figure 14D:
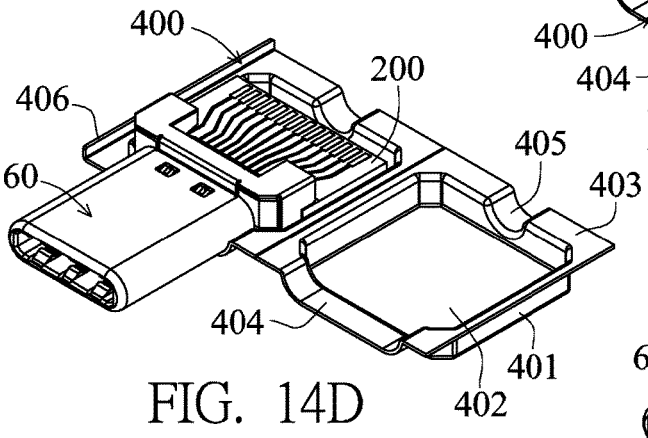
FIG. 14D is a diagram showing the implemented state according to plug of the first embodiment of the invention.
Figure 14E:
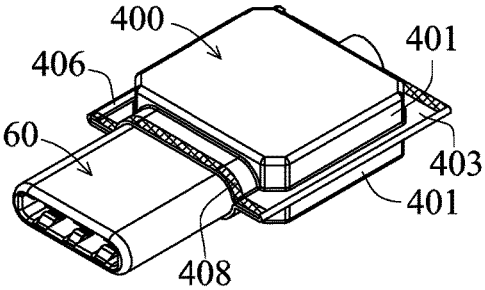
FIG. 14E is a diagram showing the implemented state according to plug of the first embodiment of the invention.

Referring to FIGS. 14A to 14E showing the variations of the rear shielding shell 400 of this embodiment. In FIG. 14A, each of the combination plates 403 of the left and right sides of one housing 401 is provided with a front-to-rear continuous snapping sheet 406 snapping to the combination plate 403 of the other housing 401, and the front and rear ends thereof are the same as FIG. 14. In FIG. 14B, each of the combination plates 403 of the left and right sides of one housing 401 is vertically provided with a front-to-rear continuous bending edge 407 shielding the outside of the combination plate 403 of the other housing 401, and the front and rear ends are the same as FIG. 14A. In FIGS. 14C to 14E, the combination plates 403 of the left and right edges of the two housings 401 are integrally connected together and can be folded and combined together, and the others are the same as FIG. 14A.

Figure 15:
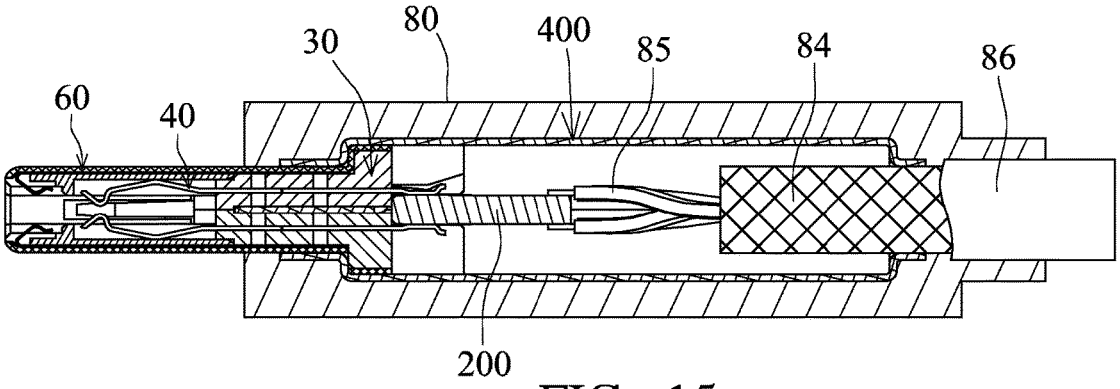
FIG. 15 is a diagram showing the implemented state according to plug of the first embodiment of the invention.

Referring to FIG. 15, the plug of this embodiment serves as the plug of a transmission cable. The transmission cable 86 is an electronic unit provided with two sets of wires 85 bonded to two rows of connection points 206 of the circuit board 200. Metal grid lines 84 covering the two sets of wires 85 are bonded to the two connection points 208 of the circuit board 200 (see FIG. 4), and then encapsulated to form a cover body 80.

Figure 16:
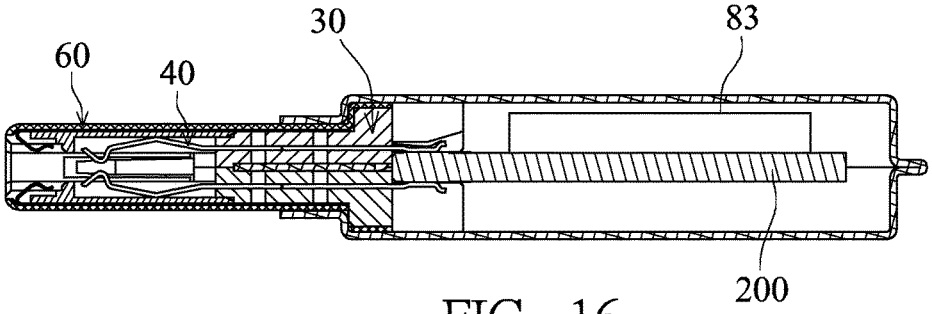
FIG. 16 is a diagram showing the implemented state according to plug of the first embodiment of the invention.
Figure 16A:
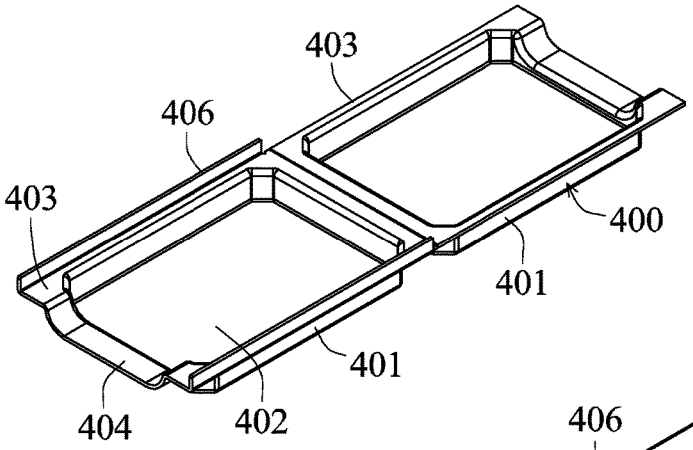
FIG. 16A is a diagram showing the implemented state according to plug of the first embodiment of the invention.
Figure 16B:
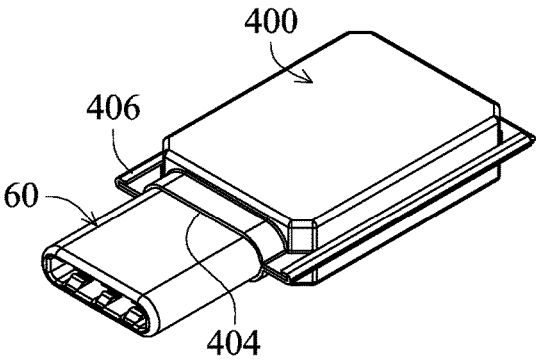
FIG. 16B is a diagram showing the implemented state according to plug of the first embodiment of the invention.

Referring to FIG. 16, this embodiment functions as a plug of a mobile disk. The circuit board 200 needs to be larger, and an electronic unit is disposed on and electrically connected to the circuit board 200. The electronic unit is a storage unit 83 electrically connected to the two terminal sets through the circuit board 200. Referring to FIGS. 16A and 16B, the combination plates 403 of the rear ends of the two housings 401 of the rear shielding shell 400 are integrally connected together and can be folded and combined together.

According to the above-mentioned description, the plug of this embodiment has the following advantages:

1. The ground shielding member 640 is integrally provided with two ground shielding sheets 641 to form a four-sided housing, to facilitate the assembling, wherein its four-sided housing and the four-sided primary housing 61 of the metal housing 60 are fitted with and rest against together, so that the structural strength of the metal housing 60 can be reinforced, and the seam can be effectively shielded.

2. The rear shielding shell 400 is formed with the two housings 401 vertically combined together, and each of the two housings 401 is provided with a chamber 402 without a combination gap, so that the easy manufacturing and the good shielding effect can be achieved.

3. The insulated seat 30 is provided with a base seat 31 and a docking part 32 mutually fitted together, wherein the base seat 31 is provided with vertically stacked first and second base seats 311 and 312, which are fixedly embedded into and injected molded with two terminal sets, respectively, so that the convenience in manufacturing can be achieved.

4. The height of the snapping convex portion 633 of the resilient snap 632 is greater than the material thickness of the metal partition plate 630, and the resilient snap 632 is provided with a bent portion 635 so that a vertical step 635 is formed between the front section and the rear end, and the middle height of the snapping convex portion 633 is substantially disposed at the middle thickness of the metal partition plate 630.

5. The insulated seat 30 provided with the fitting slot 315 can be engaged with the circuit board 200.

Referring to FIGS. 17 to 25, a dual-position duplex USB TYPE-C electrical connection socket 1 of a plate-depressed type according to this embodiment is provided with an insulated seat 12, two terminal sets, a ground shielding member 19, a metal partition plate 17, a metal housing 13 and a metal shell 132.

Figure 23:
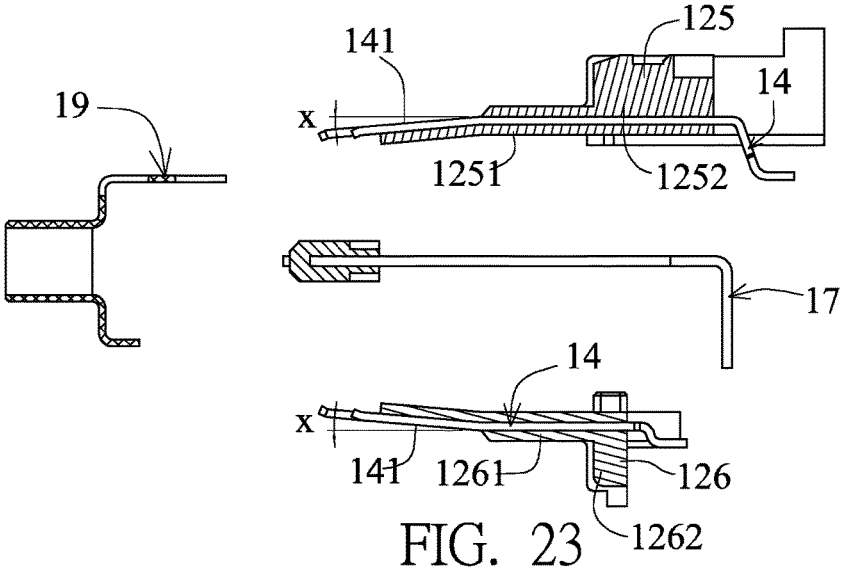
FIG. 23 is a exploded side view showing the insulated seat, the metal partition plate and the ground shielding member according to socket of the first embodiment of the invention.
Figure 25:
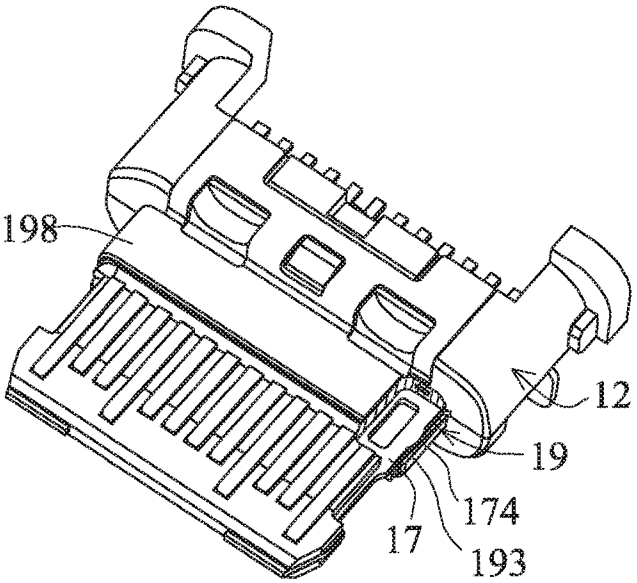
FIG. 25 is a pictorially assembled view showing the insulated seat, the ground shielding member and the metal partition plate according to socket of the first embodiment of the invention.
Figure 24:
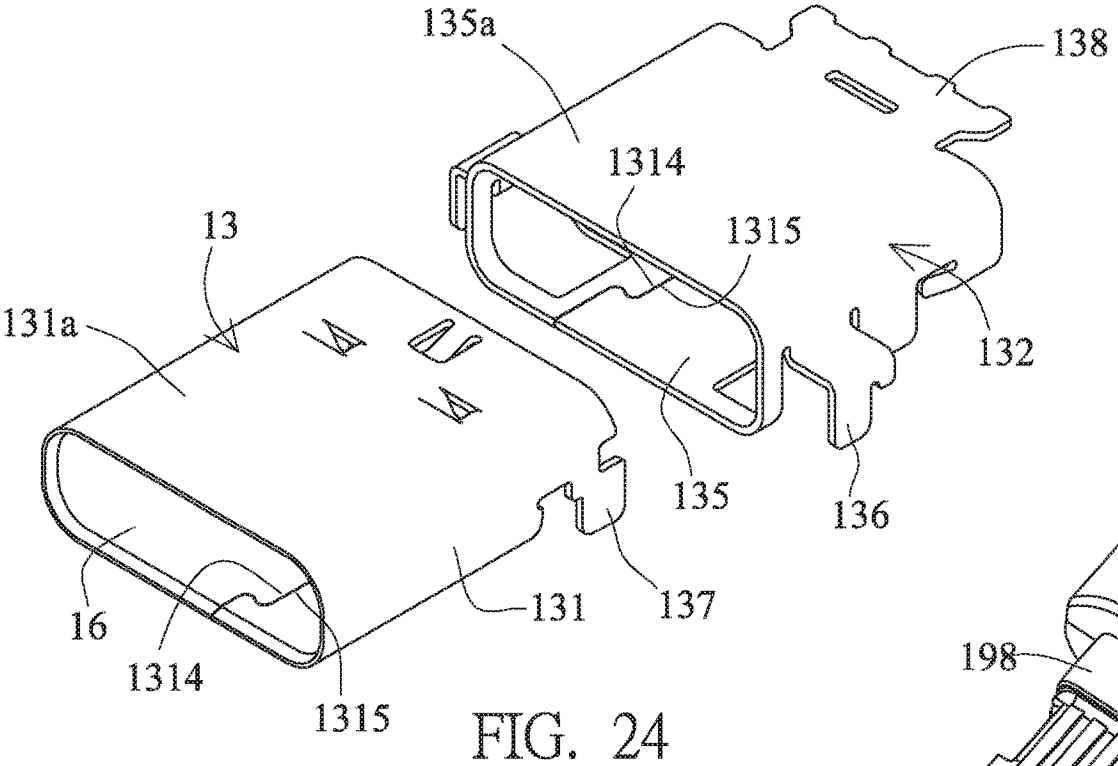
FIG. 24 is a pictorially exploded view showing the metal housing and the metal shell according to socket of the first embodiment of the invention.

The insulated seat 12 is a plastic material and provided with a base seat 122 and a docking part. The docking part is a tongue 121. A front end of the base seat 122 is projectingly provided with the tongue 121. An inner end of the tongue 121 is connected to the base seat 122. The thickness of the base seat 122 is larger than that of the tongue 121. Top and bottom surfaces of the tongue 121 are two connection surfaces having larger plate surfaces. The thickness of the tongue 121 is such that the inner section is thicker than the outer section so that inner sections 1208 of the two connection surfaces project much more than outer sections 1207 of the two connection surfaces. The insulated seat 12 is provided with a first seat 125, a second seat 126 and an outer tongue seat 129. The first and second seats 125 and 126 are stacked vertically. The first seat 125 is integrally formed with a first tongue 1251 and a first base seat 1252, and the second seat 126 is integrally formed with a second tongue 1261 and a second base seat 1262. The tongue 121 comprises the stacked first and second tongues 1251 and 1262 and the outer tongue seat 129. The first tongue 1251 of the first seat and the second tongue 1261 of the second seat are such that the inner section is thicker than the outer section so that the inner sections 1208 of the two connection surfaces project much more than the outer sections 1207 of the two connection surfaces. The outer tongue seat 129 is connected to the outer ends of the first and second tongues 1251 and 1261. The first and second base seats 1252 and 1262 are stacked to form the base seat 125. The first and second tongues 1251 and 1261 are provided with the resilient overpressure leaning against the jointing surface. As shown in FIG. 23, the outer sections of the first and second tongues 1251 and 1261 are inclined toward the jointing surface by an angle X, so that when the first and second tongues 1251 and 1261 are stacked, the first and second tongues 1251 and 1261 resiliently press against and tightly contact with each other through the resilient overpressure leaning against the jointing surface.

Each of the two terminal sets has one row of 12 first terminals 14, and the two terminal sets are respectively embedded into and injection molded with the first and second seats 125 and 126. One end of each first terminal 14 is extended and provided with a contact 141 and the other end of each first terminal 14 is extended and provided with a pin 143 extending out of a rear end of the base seat 122. First surfaces of the contacts 141 of the two terminal sets are respectively exposed from the outer sections 1207 of the two connection surfaces of the tongue 121, and second surfaces of the contacts 141 are embedded into the tongue 121 and fixed in a flat surface contact manner. So, the contacts 141 of the two terminal sets are not elastically movable and exposed and fixed to the outer sections of the first and second tongues in the flat surface contact manner. The contacts 141 of the two terminal sets are the same contact interface and vertically aligned. The contacts of the two terminal sets are arranged in an equally spaced manner. The circuit serial numbers of the connection points of the two contact interfaces are arranged reversely. As shown in FIG. 19, the upper row of contacts 21 have the connection points with the circuit serial numbers of 1 to 12 from left to right, and the lower row of contacts 141 have the connection points with the circuit serial numbers of 1 to 12 from right to left. In addition, the contacts 141 of the two terminal sets are in the forms of two rows of different lengths, that is, four longer ones and eight shorter ones.

The metal housing 13 covers the insulated seat 12 and rests against and engages with the base seat 122. The metal housing 13 is formed by bending a metal plate sheet, a front section thereof is provided with a four-sided primary housing 131, two sides of the rear end thereof are provided with two left-right symmetrical second plate connecting members 137. The four-sided primary housing 131 has four plate surfaces 131*a* integrally connected together, and the four plate surfaces 131*a* shielding the tongue 121 has no prodding hole facing the tongue 121. The four-sided primary housing 131 and the front end of the base seat 122 form a connection slot 16. The tongue 121 is horizontally suspended over the middle height of the connection slot 16 and extends frontwards. An insert port of the connection slot 16 faces frontwards. The connection slot 16 and the tongue 121 form a docking structure, so that an electrical connection plug can be reversibly inserted and electrically connected thereto at two positions for positioning. An outer end of the tongue 121 approaches the insert port of the connection slot 16. The two connection surfaces of the tongue 121 form symmetrical spaces. The shape of the connection slot 16 is top-bottom symmetrical and left-right symmetrical and has two arced sides close to a rectangle.

The metal shell 132 is formed by bending a metal plate sheet and provided with a four-sided housing 135. The four-sided housing 135 has four plate surfaces 135*a* integrally connected together, and shields the tongue 121. The four-sided housing 135 is integrally outwardly projectingly provided with two left-right symmetrical first plate connecting members 136. The two first plate connecting members 136 are formed by prodding, pressing and bending the plate surface of the four-sided housing 135. The plate surface of the four-sided housing 135 is formed with a prodding hole or holes. Two end sections of the first and second plate connecting members 136 and 137 are vertical and can be inserted, connected and positioned into a circuit board. The rear end of the second housing 132 is provided with a rear plate 138. The four-sided primary housing 131 and the four-sided housing 135 are combined and engaged together on a plate surface, that is, the connected two sides are provided with a dove-tail shaped engaging sheet 1314 and an engaging slot 1315 combined and engaged with each other, wherein the seams of both of them are staggered in the left-right direction for the mutual shielding. Because the four plate surfaces of one of the four-sided primary housing 131 and the four-sided housing 135 have no prodding hole facing the tongue 121 (docking part), the better shielding effect can be provided to the tongue 121 (docking part), and the better electrical effect can be obtained.

The metal housing 13 and the metal shell 132 are formed by bending the metal plate sheets having the same thickness, so both of them have the same structural strength and can support each other, and the seams of both of them are staggered in the left-right direction. Because both of them have the same structural strength, both of them have the averaged endurance, and the overall product needs not to be scrapped due to the damage of one single part.

In addition, the connected two sides of the four-sided primary housing 131 may also be applied with laser welding for hot melting and combining so that the combination portion forms the seamless combination.

The four-sided housing 135 of the metal shell 132 is tightly fitted with the outside of the four-sided primary housing 131 of the first housing from rear to front, and the two first plate connecting members 136 are disposed in front of the two second plate connecting members 137.

Spot welding may further be performed on the upper jointing portion between the metal housing 13 and the metal shell 132 of this embodiment. As shown in FIG. 18, two rows of welding points 1310 are formed, because the first and second housings 51 and 52 are fitted and positioned with each other, the spot welding machining can be easily operated.

The metal partition plate 17 is fixedly disposed between the first and second seats 125 and 126, the metal partition plate 17 extends from the base seat 122 to the tongue 121 to separate the contacts 141 of the two terminal sets. The outer tongue seat 129 is embedded into, combined with and fixed to the outer end (front end) of the metal partition plate 17. The two connection surfaces of the outer tongue seat 129 are provided with depressed portions 1293. The outer ends of the contacts 141 of the two terminal sets are connected to the depressed portions 1293 of the two connection surfaces. Two sides of the metal partition plate 17 are provided with depressed engaging slots 175. Two sides of the tongue 121 are provided with concave portions 1205 corresponding to the engaging slots 175 of the metal partition plate 17 (see FIG. 17). The rear of each of the engaging slots 175 of the two sides of the metal partition plate 17 is provided with a laterally projecting convex portion 174. The plate surfaces of the two sides of the metal partition plate 17 are provided with two longitudinal holes 1712 and two engagement holes 1713, and each of two sides of the rear end thereof extends downwards to form a pin 177. The two longitudinal holes 1712 can make the two convex portions 174 form the laterally elastically movable structure. The two engagement holes 1713 engage with two engagement blocks 1273 on the connection surface of the second seat 126.

The ground shielding member 19 is formed by bending a metal plate sheet, and is integrally provided with two ground shielding sheets 190. Each of the two ground shielding sheets 190 is provided with a first plate sheet 191 and a second plate sheet 192 with a step formed therebetween. The two first plate sheets 191 cover the inner sections 1208 of the two connection surfaces of the tongue 121. The two second plate sheets 192 cover top and bottom surfaces of the base seat 122 and are electrically connected to the metal housing 13. Although the second plate sheet 192 is a smooth plate sheet, no resilient convex portion is provided to resiliently resting against the metal housing. The two sides of the two first plate sheets 192 are integrally connected together through two side sheets 193. The two first plate sheets 191 and the two side sheets 193 form a four-sided housing 198. The four-sided housing 198 is combined and engaged together on a plate surface. That is, the connected two sides are provided with a dove-tail shaped engaging sheet 1901 and an engaging slot 1902 combined and engaged with each other. The four-sided housing 198 is fitted with and positioned at the inner sections 122 of the two connection surfaces of the tongue 12 to fit and position the vertically stacked first and second tongues 1251 and 1261 and to strengthen the combination force between the first and second tongues 1251 and 1261. The two side sheets 193 of the four-sided housing 198 and the convex portions 174 of the two sides of the metal partition plate 17 resiliently contact together (see FIG. 25), so that the metal partition plate 17 and the metal housing 13 form the electrical connection and the better electric effect can be obtained.

Figure 22:
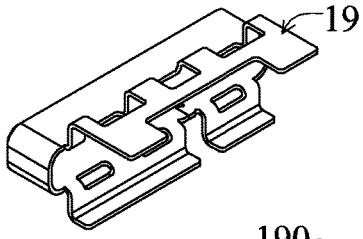
FIG. 22 is a pictorial view showing a ground shielding member according to socket of the first embodiment of the invention.
Figure 22A:
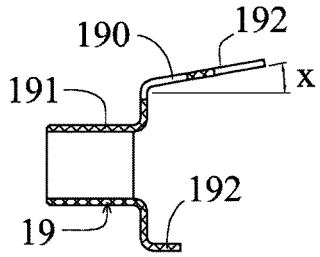
FIG. 22A is a pictorial view showing another implementation of the ground shielding member of the socket according to the first embodiment of the invention.
Figure 21:
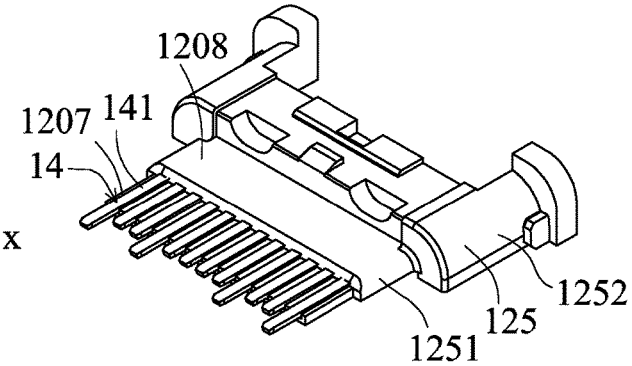
FIG. 21 is a pictorially exploded view showing an insulated seat, a metal partition plate and a ground shielding member according to socket of the first embodiment of the invention.
Figure 21:
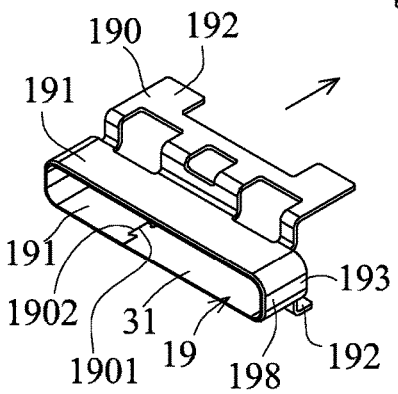
Figure 21:
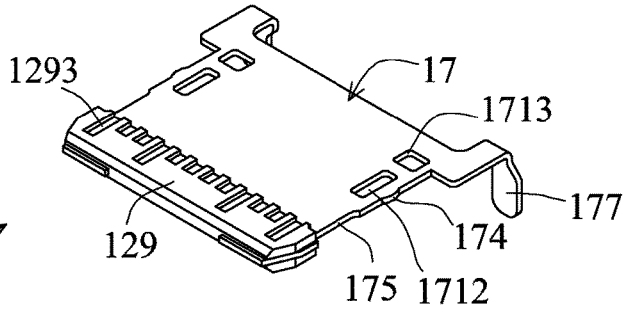
Figure 21:
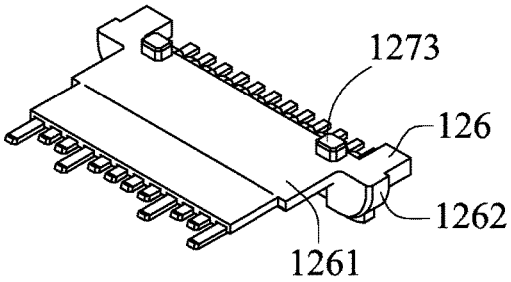

Referring to FIG. 22A, the second plate sheet 192 of the ground shielding member 19 of this embodiment may be provided with a negative angle X leaning against the metal housing. Thus, after the ground shielding member 19 is assembled, the second plate sheet 192 can resting against the metal housing 60 in an overpressure manner to ensure the grounding. Therefore, although the second plate sheet 192 is a smooth plate sheet, it can be ensured to rest against the metal housing 60.

Upon assembling, as shown in FIG. 17, the metal housing 50 and the metal shell 132 are firstly fitted and positioned together, the insulated seat 12, the ground shielding member 19 and the metal partition plate 17 are assembled and then assembled into the metal housing 13 from rear to front. Then, the rear plate 138 of the metal shell 132 is bent to shield the rear end of the insulated seat 12.

Figure 26:
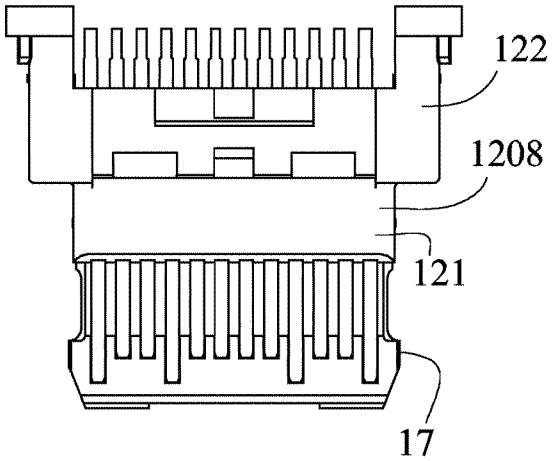
FIG. 26 is an assembled top view showing the insulated seat, the ground shielding member and the metal partition plate according to socket of the first embodiment of the invention.
Figure 27:
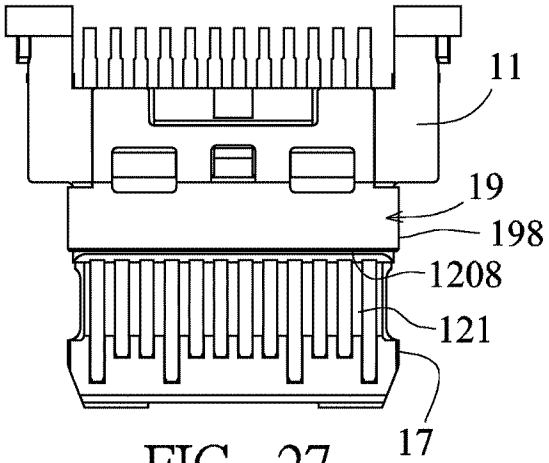
FIG. 27 is an assembled top view showing the insulated seat, the ground shielding member and the metal partition plate according to socket of the first embodiment of the invention.
Figure 28:
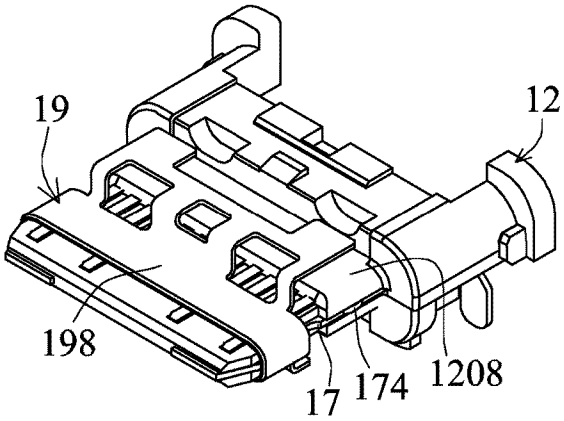
FIG. 28 is a pictorial view when the ground shielding member and the insulated seat according to socket of the first embodiment of the invention are not assembled to the predetermined position.
Figure 29:
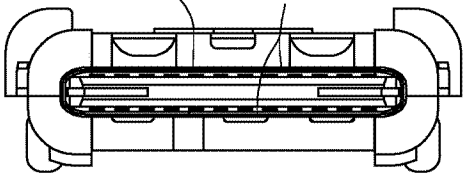
FIG. 29 is a front view when the ground shielding member and the insulated seat according to socket of the first embodiment of the invention are not assembled to the predetermined position.
Figure 30:
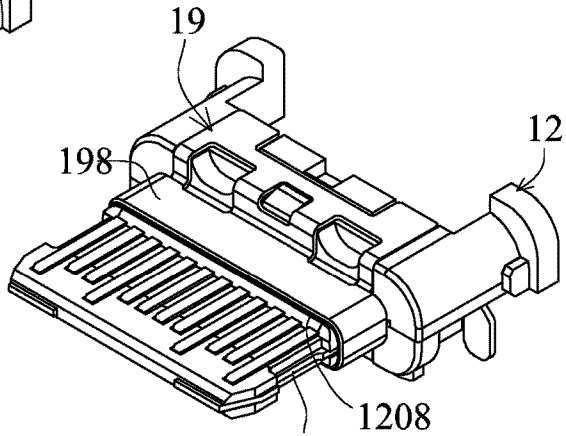
FIG. 30 is a pictorial view when the ground shielding member and the insulated seat according to socket of the first embodiment of the invention are assembled to the predetermined position
Figure 31:
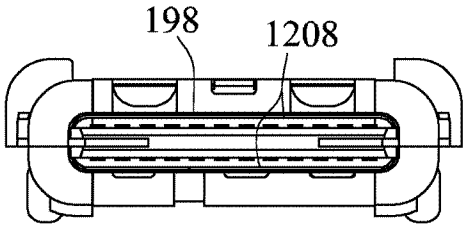
FIG. 31 is a front view when the ground shielding member and the insulated seat according to socket of the first embodiment of the invention are assembled to the predetermined position.

Referring to FIGS. 26 to 31, as shown in FIG. 27, after the four-sided housing 198 of the ground shielding member 19 is fitted with and positioned at the inner sections 1208 of the two connection surfaces of the tongue 121, the width of the four-sided housing 198 is the same as the maximum width of the metal partition plate 17. Thus, as shown in FIG. 26, the widths of the inner sections 1208 of the two connection surfaces of the tongue 121 need to be smaller than the maximum width of the metal partition plate 17. As shown in FIGS. 28 and 29, a four-sided cover shell 35 of the ground shielding member 19 before being assembled to the predetermined position has the width greater than the maximum width of the metal partition plate 17, and has the height smaller than the heights of the inner sections 1208 of the two connection surfaces. Thus, the four-sided housing 198 of the ground shielding member 19 can be fitted into the tongue 121. As shown in FIGS. 30 and 31, when the four-sided housing 198 is fitted with the inner section of the tongue 121, the resilient deformation decreases the width and increases the height so that it can be tightly fitted with and positioned at the inner sections 1208 of the two connection surfaces of the tongue 121.

The four-sided housing 198 of the ground shielding member 19 is fit from the outer end of the tongue 121 to achieve the assembling convenience.

The electrical connection socket of this embodiment is in the form of a horizontal type. That is, the insert port of the connection slot 16 faces frontwards, and the tongue 121 horizontally extends frontwards, so the outer end of the tongue 121 is a front end. However, a side-standing type (the insert port of the connection slot faces frontwards, and the tongue vertically extends frontwards) or a vertical type (the insert port of the connection slot 16 faces upwards, and the tongue vertically extends upwards) electrical connection socket implemented using the technical characteristics of the invention still falls within the modification of the invention.

According to the above-mentioned descriptions, the socket of this embodiment can be concluded to have the following advantages.

1. The insulated seat 12 is provided with the directly stacked first and second seats 125 and 126, which are respectively fixedly embedded into and injected molded with a terminal set so that the convenience in manufacturing can be achieved.

2. Although the first and second tongues 1251 and 1261 of this embodiment are only directly vertically stacked, without the limitation and engagement in the direction perpendicular to the two connection surfaces of the tongue, the outer tongue seat 129 has the overall thickness of the tongue and is embedded into and fixed to the metal partition plate 17. Using the metal housing 13 resting against and being positioned at the base seats of the first and second seats 125 and 126, the first and second tongues 1251 and 1261 and the outer tongue seat 129 still can achieve the good combining and positioning effects and can be conveniently manufactured and assembled.

3. The ground shielding member 19 is integrally provided with two ground shielding sheets and fitted with and positioned at the insulated seat, so that the convenience in manufacturing and assembling can be achieved.

4. The tongue of the insulated seat is provided with the mutually stacked first and second tongues 1251 and 1261, and the first and second tongues are provided with the resilient overpressure leaning against the jointing surface, so that when the first and second tongues are stacked together, the first and second tongues resiliently press against each other through the resilient overpressure leaning against the jointing surface to achieve the flat contact without curving the metal housing.

5. The ground shielding member 19 is integrally provided with a four-sided cover shell 198 fitted with and positioned at the inner sections 1208 of the two connection surfaces of the tongue 121 to fit and position the vertically stacked first and second tongues 1251 and 1261, so that the combination of the first and second tongues 1251 and 1261 can be enhanced.

6. The two side sheets 193 of the four-sided cover shell 198 of the ground shielding member and the convex portions 174 of the two sides of the metal partition plate 17 resiliently contact together, so that the metal partition plate 17 and the metal housing 50 form the electrical connection, and the better electric effect can be obtained.

7. The second plate sheet 192 of the ground shielding member 19 is provided with a negative angle X leaning against the metal housing 60. Thus, after the ground shielding member 19 is assembled, the second plate sheet 192 can rest against the metal housing 60 in an overpressure manner to ensure the grounding. Thus, although the second plate sheet 192 is a smooth plate sheet, it can still ensure to rest against the metal housing 60. Although the second plate sheet 192 is a smooth plate sheet, the pressing convenience still can be achieved.

Referring again to FIG. 3, the socket 1 and the plug 2 of this embodiment can be electrically connected together in a reversible and duplex dual-position manner to achieve the doubled transmission and easy insertion effect. That is, when the front side or the reverse side of the plug 2 is inserted into the connection slot 16 of the socket 1, the contacts 44 of the two terminal sets of the plug 2 are electrically connected to the contacts 141 of the two terminal sets of the socket 1, the tongue 121 of the socket 1 is connected to a connection slot 325 of the plug 2, the inner sections of the two connection surfaces of the tongue 121 project much more beyond the outer sections of the two connection surfaces to work in conjunction with the front-high-rear-low structure of the connection slot 325 for fitting, and the contact 643 of the ground shielding member 640 of the plug is electrically connected to the first plate sheet 191 of the ground shielding member 19 of the socket.

In addition, the snapping convex portion 633 of the resilient snap 632 of the plug snaps to the engaging slot 175 of the metal partition plate 17 of the socket, so that the plug and the socket form the inner snapping.

Figure 32:
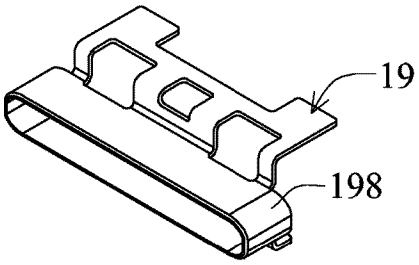
FIG. 32 is a pictorial view showing the ground shielding member according to the second embodiment of the invention.

Referring to FIG. 32, the second embodiment of the invention is substantially the same as the socket of the first embodiment except for the difference that the four-sided cover shell 198 of the ground shielding member 19 of this embodiment is formed of a metal material by way of drawing extension molding, so that no seam is present.

Figure 33:
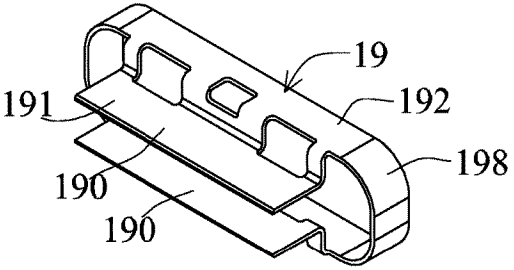
FIG. 33 is a pictorial view showing the ground shielding member according to the third embodiment of the invention.

Referring to FIG. 33, the third embodiment of the invention is substantially the same as the socket of the first embodiment except for the difference that the four-sided housing 198 of the ground shielding member 19 of this embodiment is formed with the second plate sheets 192 of the two ground shielding sheets 190, and the four-sided housing 198 is fitted with and positioned at the base seat of the insulated seat 12.

Figure 35:
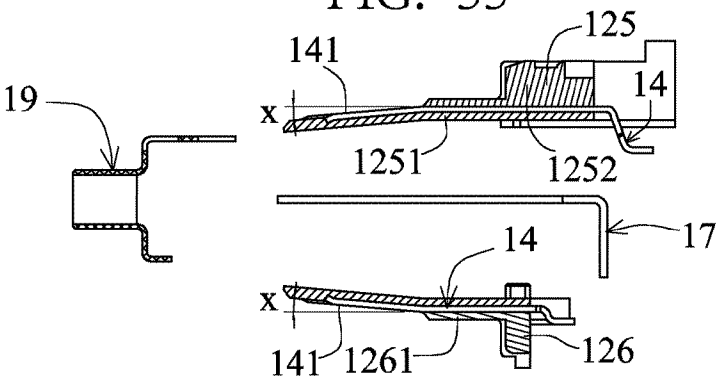
FIG. 35 is an exploded side view showing the insulated seat, the metal partition plate and the ground shielding member according to the fourth embodiment of the invention.
Figure 34:
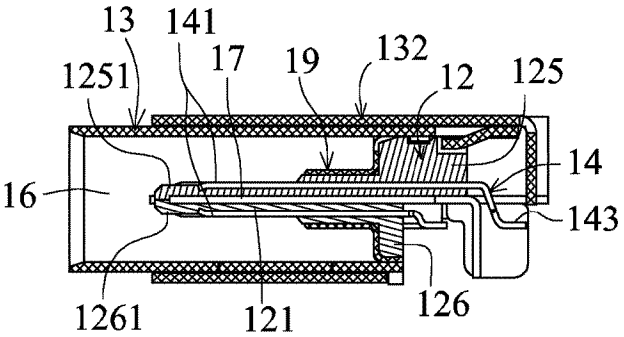
FIG. 34 is a side cross-sectional view according to the fourth embodiment of the invention.

Referring to FIGS. 34 and 35, the fourth embodiment of the invention is substantially the same as the socket of the first embodiment except for the difference that the tongue 121 of the insulated seat 12 of this embodiment is directly formed by the stacked first and second tongues 1251 and 1261 without the provision of an outer tongue seat to be embedded into and fixed to the metal partition plate 17.

Figure 37:
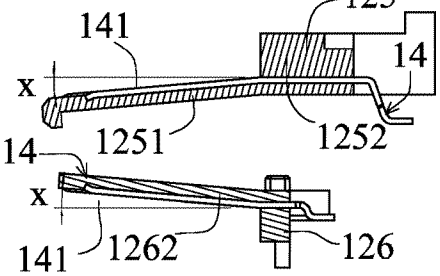
FIG. 37 is an exploded side view showing the insulated seat according to the fifth embodiment of the invention.
Figure 36:
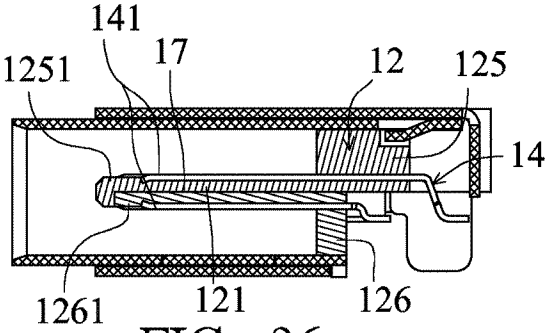
FIG. 36 is a side cross-sectional view according to the fifth embodiment of the invention.

Referring to FIGS. 36 and 37, the fifth embodiment of the invention is substantially the same as the fourth embodiment except for the difference that the outer end of the first tongue 1251 of the first seat of the insulated seat 12 of this embodiment forms the overall height of the outer end of the tongue 12. In addition, this embodiment is not provided with the ground shielding member and the metal partition plate.

Referring to FIG. 38 to FIG. 41, the sixth embodiment of the invention is a plate-depressed type bidirectional duplex USB TYPE-C electrical connection socket, which is provided with an insulated seat 12, two rows of first terminals 14, a metal housing 13, a metal shell 132, a metal partition plate 17 and two ground shielding sheets 190.

The insulated seat 12 is made of a plastic material and provided with a base seat 122 and a tongue 121. The front end of the base seat 122 is project provided with the tongue 121. The tongue 121 is provided with two connection surfaces with the larger plate surfaces. The thickness of the base seat 122 is larger than that of the tongue 121. The insulated seat 12 is provided with the vertically stacked first and second seats 125 and 126. The first and second seats 125 and 126 are respectively embedded into and injection molded with the row of first terminals 40. The first seat 125 is integrally formed with an upper half portion of the tongue 121 and an upper half portion of the base seat 122. The second seat 126 is integrally formed with a lower half portion of the tongue 121 and a lower half portion of the base seat 122. The top surface of the base seat 122 is provided with a concave surface 1221, and the concave surface 1221 is provided with an engagement block 1222.

Figure 3:
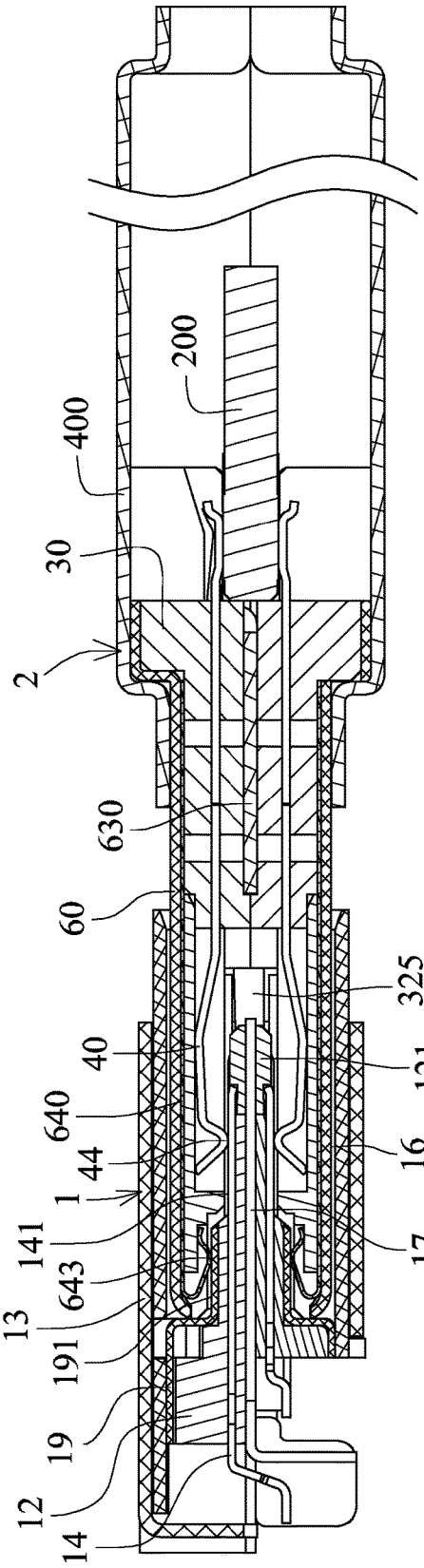
FIG. 3 is an assembled side cross-sectional view showing docking between the plug and the socket according to the first embodiment of the invention.
Figures 4, 5:
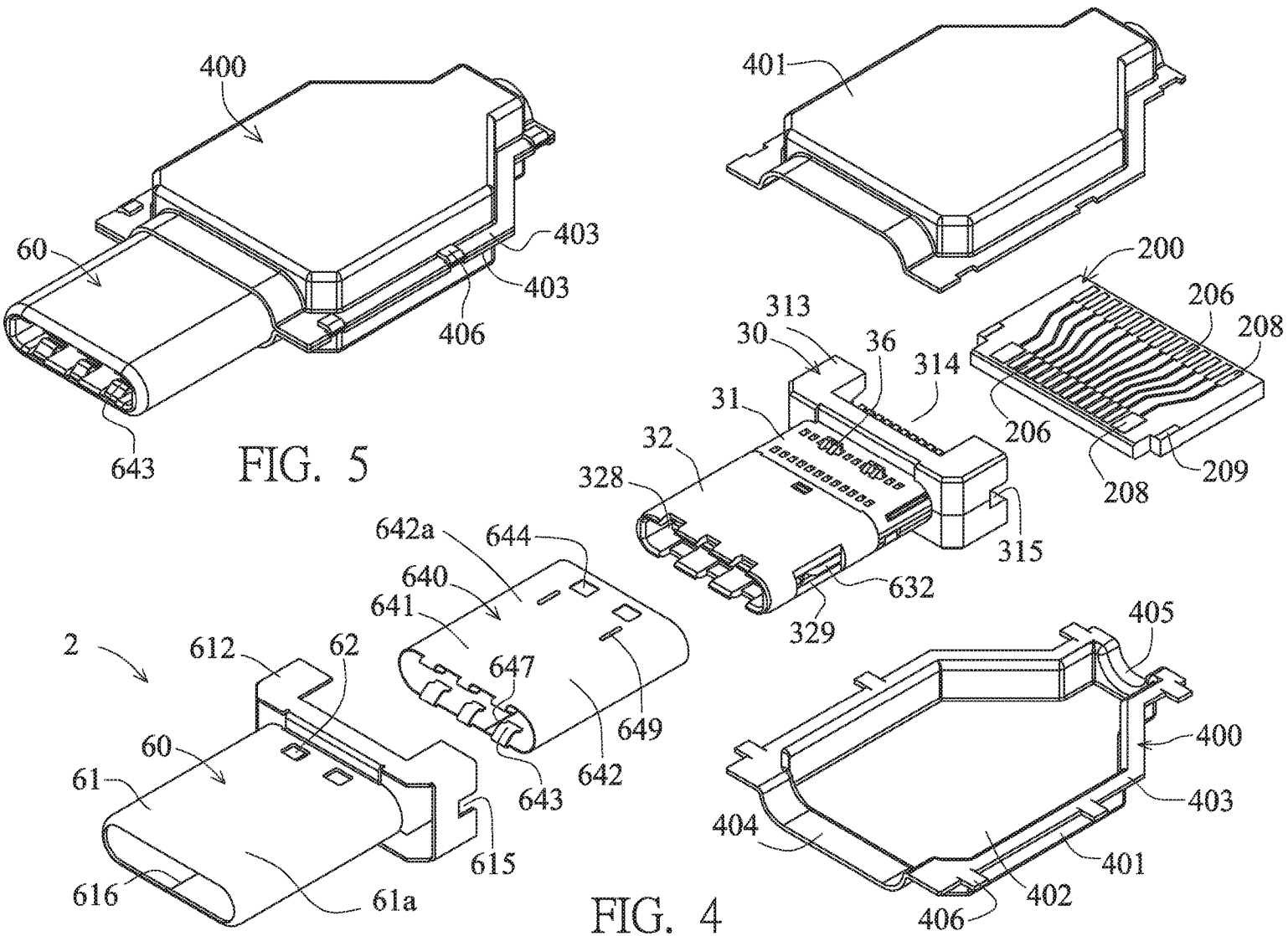
FIG. 4 is a pictorially exploded view according to plug of the first embodiment of the invention.
FIG. 5 is a pictorially assembled view according to plug of the first embodiment of the invention.
Figure 6:
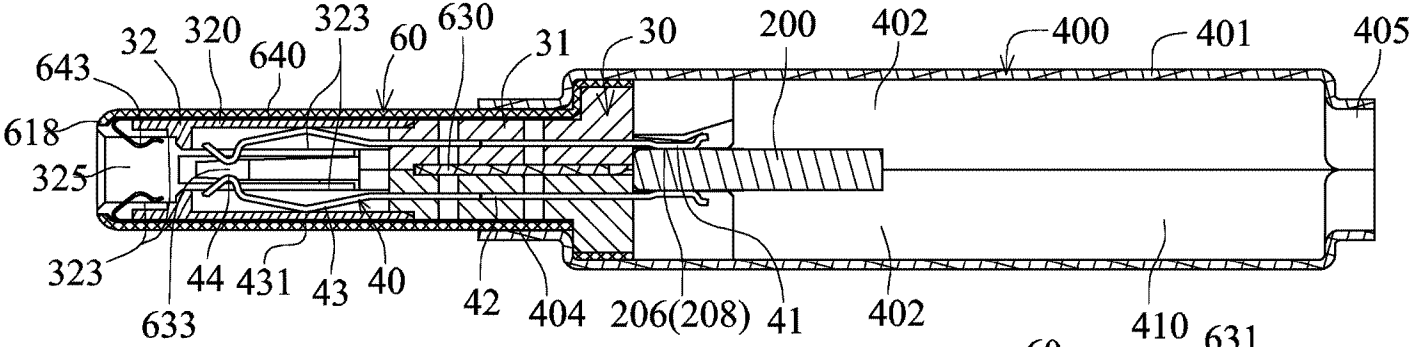
FIG. 6 is a side cross-sectional view according to plug of the first embodiment of the invention.
Figure 8:
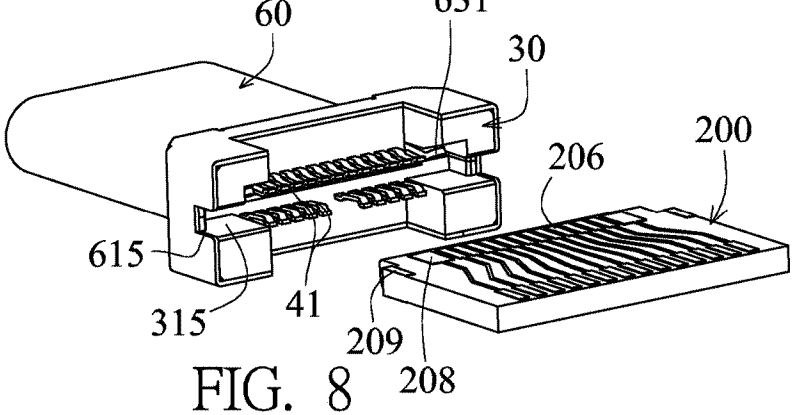
FIG. 8 is a pictorially exploded view showing an insulated seat and a circuit board according to plug of the first embodiment of the invention.
Figure 9:
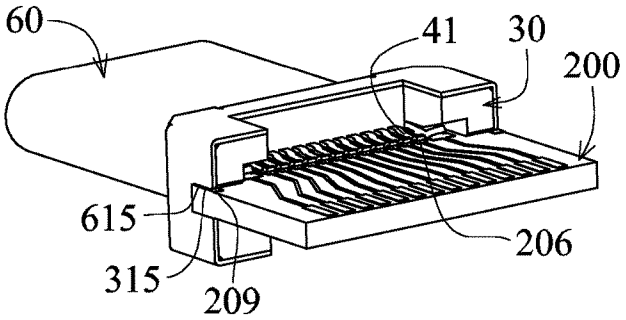
FIG. 9 is a pictorially assembled view showing the insulated seat and the circuit board according to plug of the first embodiment of the invention.

The two rows of the twelve first terminals 14 are respectively embedded into and injection molded with the first and second seats 125 and 126. The first terminal 14 is integrally pressed and bent to provide an extension 144, a fixing portion 142 and a pin 143. Partial top and bottom surfaces of the fixing portion 142 are embedded into and fixed to the base seat 122. The extension 144 is connected to the front end of fixing portion 142 and extends to the tongue 121. The inner surface of the extension 144 embedded and in flat surface contact with the tongue 121 and the outer surface of the front section of the extension 144 are exposed from two connection surfaces of the tongue 121 to form a contact 141. So, the extension 144 is fixed and elastically non-movable, and the pin 143 is connected to the rear end of the fixing portion 142 and extends out of the first base seat 122. The contacts 141 of the two rows of the first terminals 14 are disposed on the two connection surfaces of the tongue 121, respectively, and are vertically aligned. The contacts 141 of the two rows of the first terminals 14 are the same contact interface. The circuit serial numbers of the connection points of the two contact interfaces are arranged reversely, as shown in FIG. 3, and the upper row of the contacts 141 have the connection points with the circuit serial numbers of 1 to 12 from left to right, and the lower row of contacts 141 have the connection points with the circuit serial numbers of 1 to 12 from right to left.

The metal housing 13 covers the insulated seat 12. The metal housing 13 rests against and locks to the base seat 122, and the front section thereof is provided with a four-sided primary housing 131. The inside of the four-sided primary housing 131 and the front end of the base seat 122 form a connection slot 16. An electrical connection plug may be inserted and electrically connected to the connection slot 16. The tongue 121 is horizontally suspended at the middle height of the connection slot 16 and extends frontwards. The inlet of the connection slot faces frontwards. The two connection surfaces of the tongue 121 form symmetrical spaces. The shape of the connection slot 16 is top-bottom symmetrical and left-right symmetrical and has two arced sides approaching a rectangle.

The metal partition plate 17 is fixedly disposed between the first and second seats 125 and 126.

The two grounding sheets 190 have ladder shapes and in flat surface contact with and positioned at the rear sections of the two connection surfaces of the tongue 121 and the top and bottom surfaces of the front section of the base seat 122. The two grounding sheets 190 contact the metal housing 13.

Figures 38, 38A, 39, 40, 41:
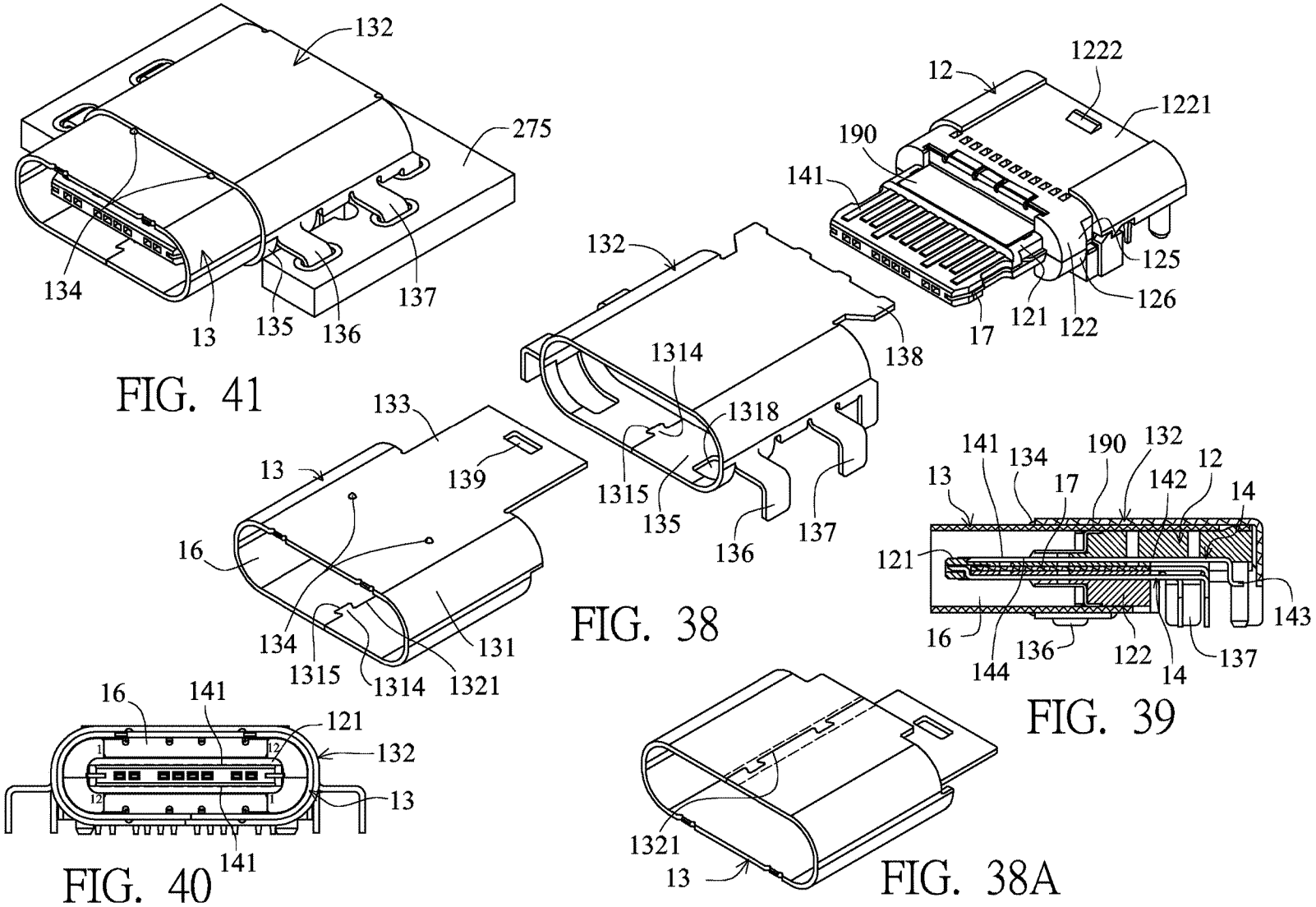
FIG. 38 is a stereoscopic exploded view according to the sixth embodiment of the invention.
FIG. 38A is a pictorial view showing the metal housing 131 inverted according to the sixth embodiment of the invention.
FIG. 39 is a cross-sectional side view according to the sixth embodiment of the invention.
FIG. 40 is a front view according to the sixth embodiment of the invention.
FIG. 41 is a pictorially assembled view according to the sixth embodiment of the invention.

The characteristic of this embodiment resides in that the outside of the metal housing 13 is fitted with and rested with a metal shell 132. The metal housing 13 is formed by bending a metal plate sheet and provided with a four-sided primary housing 131. The top end of the four-sided primary housing 131 is provided with two stopping convex portions 134 and backward extended with an engaging combining plate 133. The rear section of the engaging combining plate 133 is provided with an engagement hole 139. The metal shell 132 is formed by bending a metal plate sheet and provided with a four-sided housing 135. The four-sided housing 135 is integrally outwardly projectingly provided with two left-right symmetrical first plate connecting members 136. The two first plate connecting members 136 are formed by prodding, pressing and bending the plate surface of the four-sided housing 135. The plate surface of the four-sided housing is formed with a prodding hole 1318. The metal shell 132 disposed in back of the two first plate connecting members 136 is further provided with two left-right symmetrical second plate connecting members 137. Two end sections of the first and second plate connecting members 136 and 137 are vertical and can be inserted, connected and positioned into a circuit board 275. The rear end of the metal shell 132 is provided with a rear plate 138. The four-sided primary housing 131 and the four-sided housing 135 are combined and engaged together on a plate surface. That is, the connected two sides are provided with a dove-tail shaped engaging sheet 1314 and an engaging slot 1315 combined and engaged with each other and the connected two sides may implemented by way of laser welding and hot melting combination so that the combination portions have no gap 1321. As shown in FIG. 38A, the gapless combination 1321 ranges from the front end to the rear end of the phantom line region.

The four-sided housing 135 of the metal shell 131 is tightly fitted with the outside of the four-sided primary housing 131 of the metal housing from rear to front, the engaging combining plate 133 is in flat surface contact with the inner surface of top end of the metal shell 131, and the stopping structure is provided between the metal shell 132 and the metal housing 131 to stop the metal shell 132 from moving frontwards. The stopping structure is provided with two stopping convex portions 134 on the top end of the four-sided primary housing 131, wherein the top end of the front edge of the four-sided housing 135 of the metal shell 132 may be stopped by the two stopping convex portions 134. After the metal shell 132 is fitted and combined with the metal housing 13, the insulated seat 12 is assembled from rear to front. The engaging combining plate 133 is combined with the concave surface 1221 of the base seat 122 of the insulated seat 12. The engagement hole 139 locks to the engagement block 1222. After the metal housing 13 and the insulated seat 12 are assembled, the rear plate 138 is bent to shield the rear end of the insulated seat 12. Each of the set of four plate surfaces of the four-sided primary housing 131 and the set of four plate surfaces of the four-sided housing 135 may have top and bottom flat surfaces and left and right arced plate surfaces, and a front end of the four-sided primary housing 131 projects frontward much more than a front end the four-sided housing 135.

Referring to FIG. 42, spot welding may further be performed on the upper jointing portion between the metal shell 132 and the metal housing 13 of this embodiment. As shown in Figure, two rows of welding points 1310 are formed, because the metal shell 132 and the metal housing 13 are fitted and positioned with each other, the spot welding machining can be easily operated.

The metal housing 13 and the metal shell 132 are formed by bending the metal plate sheets having the same thickness, so both of them have the same structural strength and can support each other. Because both of them have the same structural strength, both of them have the averaged endurance, and the overall product needs not to be discarded due to the damage of one single part.

Referring to FIGS. 43 and 44, the seventh embodiment of the invention is substantially the same as the sixth embodiment except for the difference that the stopping structure of this embodiment is provided with two upwardly projecting stopping engaging sheets 1317 on the bottom end of the trailing edge of the four-sided housing 135 of the metal shell 132. The stopping engaging sheet 1317 can be stopped at the bottom end of the trailing edge of the four-sided primary housing 131 of the metal housing 131.

Referring to FIG. 45, the eighth embodiment of the invention is substantially the same as the seventh embodiment except for the difference that the front end of the four-sided housing 135 of the metal shell 132 of this embodiment is integrally provided with a reversely bent plate 1311, the reversely bent plate 1311 stacked outside the top surface of the four-sided housing 135, and the reversely bent plate 1311 integrally extends downwardly to provide the two first plate connecting members 136. Thus, the four-sided housing 135 also has no prodding hole to have the stronger structure.

Figure 46:
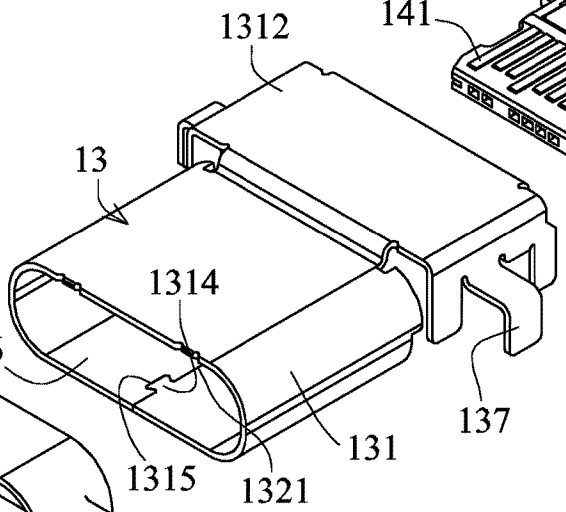
FIG. 46 is a stereoscopic exploded view according to the ninth embodiment of the invention.
Figure 46:
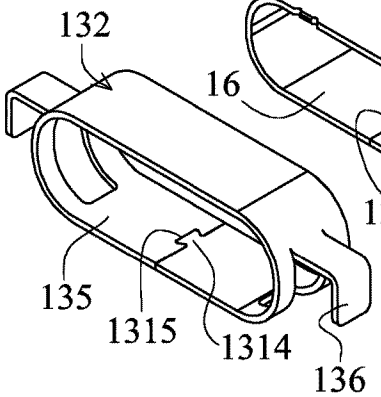
Figure 47:
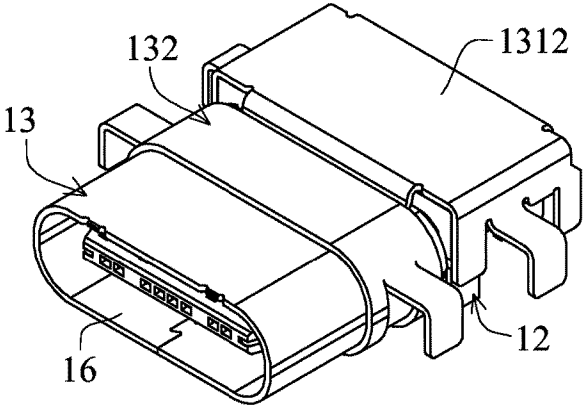
FIG. 47 is a pictorially assembled view according to the ninth embodiment of the invention.

Referring to FIGS. 46 and 47, the ninth embodiment of the invention is substantially the same as the sixth embodiment except for the difference that the connection slot 16 of this embodiment has the larger plate depressed level, wherein the base seat 122 of the insulated seat 12 is formed with a step, and the four-sided housing 135 of the metal shell 132 is fitted with the four-sided primary housing 131 of the metal housing 131 from front to rear. In addition, the two second plate connecting members 137 in back of the two first plate connecting members 136 are disposed on the left and right sides of the rear section of the metal housing 131.

Figure 48:
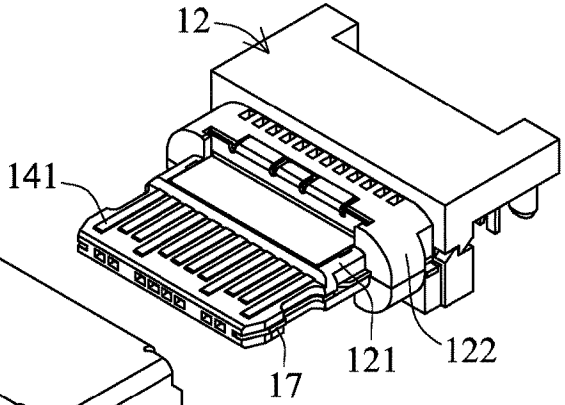
FIG. 48 is a pictorial view showing the metal shell according to the tenth embodiment of the invention.
Figure 48:
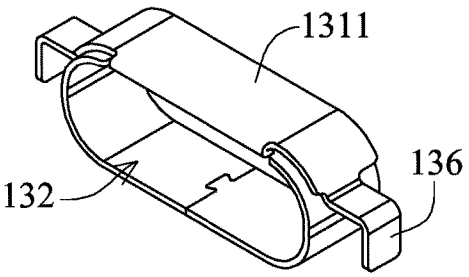

Referring to FIG. 48, the tenth embodiment of the invention is substantially the same as the ninth embodiment except for the difference that the front end of the four-sided housing 135 of the metal shell 132 of this embodiment is integrally provided with a reversely bent plate 1311, wherein the reversely bent plate 1311 is stacked outside of top surface of the four-sided housing 135, and the reversely bent plate 1311 integrally downwardly extends to provide the two first plate connecting members 136.

Figure 49:
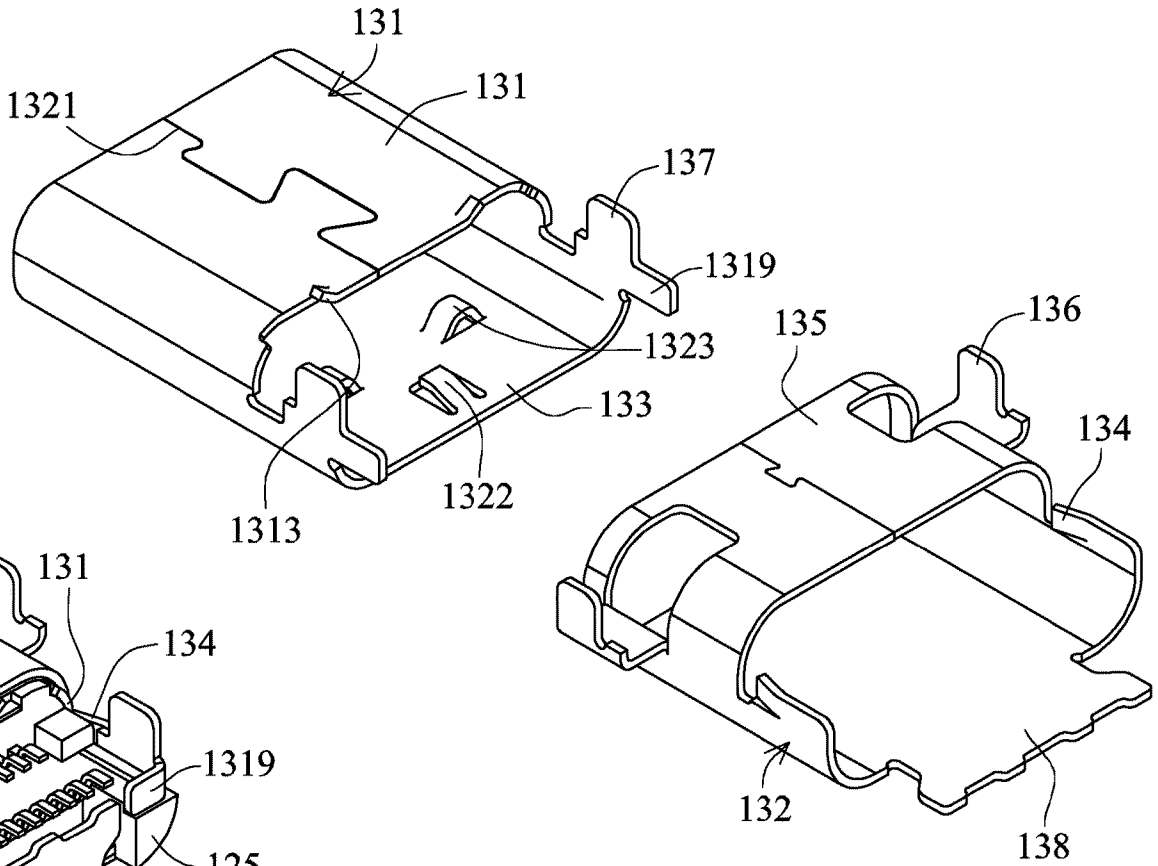
FIG. 49 is a stereoscopic exploded view showing the metal housing and the metal shell according to the eleventh embodiment of the invention.
Figure 50:
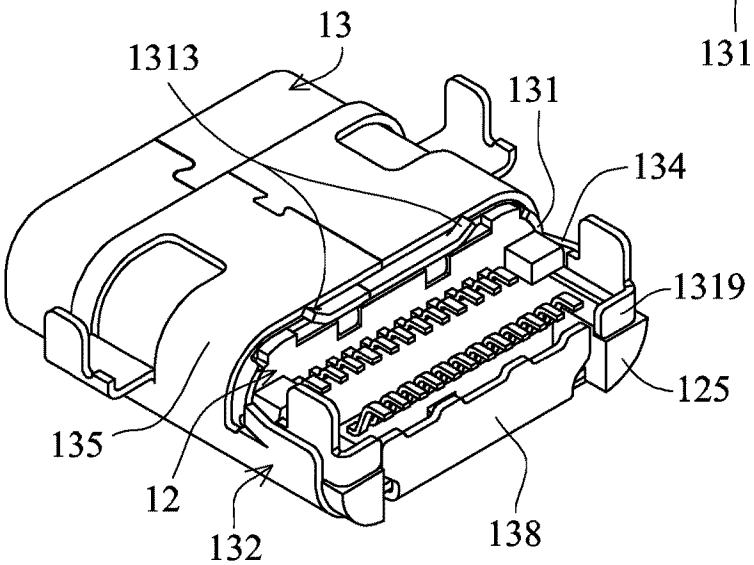
FIG. 50 is a pictorially assembled view showing the metal housing and the metal shell according to the eleventh embodiment of the invention.

Referring to FIGS. 49 and 50, the eleventh embodiment of the invention is substantially the same as the seventh embodiment except for the difference that the stopping structure of this embodiment is provided with: an inwardly projecting stopping engaging sheet 1317 on each of the left and right sides of the rear of the four-sided housing 135 of the metal shell 132, wherein the stopping engaging sheet 1317 can be stopped at the left and right sides of the trailing edge of the four-sided primary housing 131 of the metal housing 131; and provided with two downwardly projecting stopping engaging sheets 1313 on the bottom end of the trailing edge of the four-sided primary housing 131 of the metal housing 131, wherein the stopping engaging sheet 1313 can be stopped at the bottom end of the trailing edge of the four-sided housing 135 of the metal shell 132, so that the metal shell 132 and the metal housing 13 can be combined and locked together through the stopping engaging sheet 1317 and the stopping engaging sheet 1313.

In addition, the two second plate connecting members 137 in back of the two first plate connecting members 136 are disposed on left and right sides of the rear section of the metal housing 131, and each of the left and right sides of the rear end is can be bent to provide a stopper plate 1319. The engaging combining plate 133 of the metal housing 131 is provided with a resilience engaging sheet 1322 and two stopping convex portions 1323. After the metal shell 132 and the metal housing 13 are fitted together, the insulated seat 12 is assembled from rear to front, the two stopping convex portions 1323 can stop the insulated seat 12 from moving frontwards, and the resilience engaging sheet 1322 can stop the insulated seat 12 from ejecting backwards. The two stopper plates 1319 and the rear plate 138 are again bent, the rear plate 138 shields the rear end of the insulated seat 12, and the two stopper plates 1319 are stopped at the bottom end of the first seat 125, as shown in FIG. 50.

Figure 51:
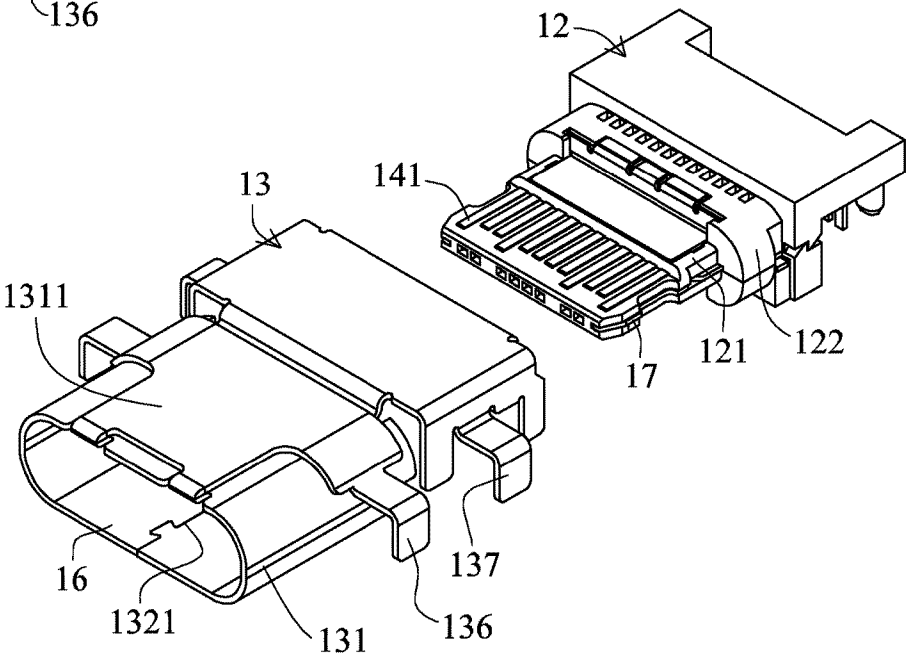
FIG. 51 is a stereoscopic exploded view according to the twelfth embodiment of the invention.
Figure 52:
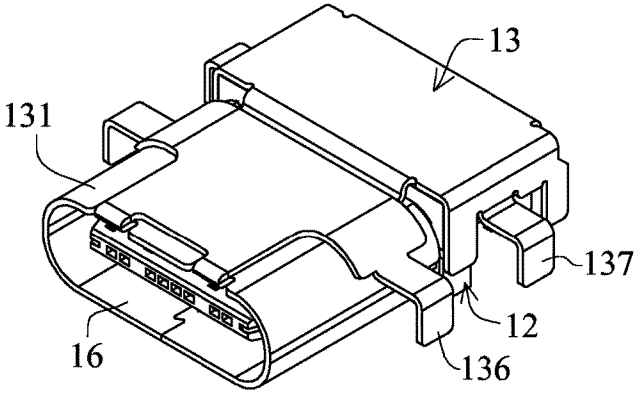
FIG. 52 is a pictorially assembled view according to the twelfth embodiment of the invention.

Referring to FIGS. 51 and 52, the twelfth embodiment of the invention is substantially the same as the ninth embodiment except for the difference that the characteristic of this embodiment resides in that the front end of the four-sided primary housing 131 of the metal housing 13 is integrally provided with a reversely bent plate 1311, the reversely bent plate 1311 is stacked outside of top surface of the four-sided primary housing 131, and the reversely bent plate 1311 integrally downwardly extends to provide two first plate connecting members 136 disposed on the left and right sides of the rear section of the four-sided primary housing 1316, respectively. The first plate connecting member 136 can be connected to and positioned on a circuit board.

Figure 53:
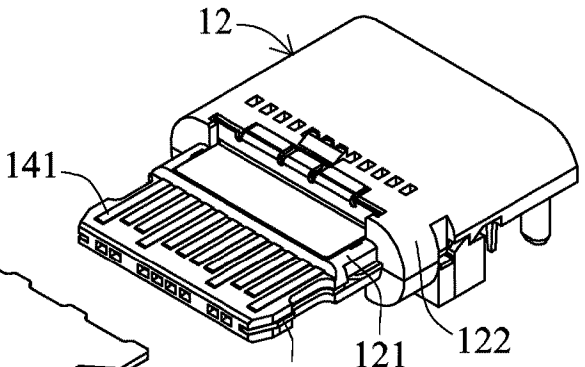
FIG. 53 is a stereoscopic exploded view according to the thirteenth embodiment of the invention.
Figure 53:
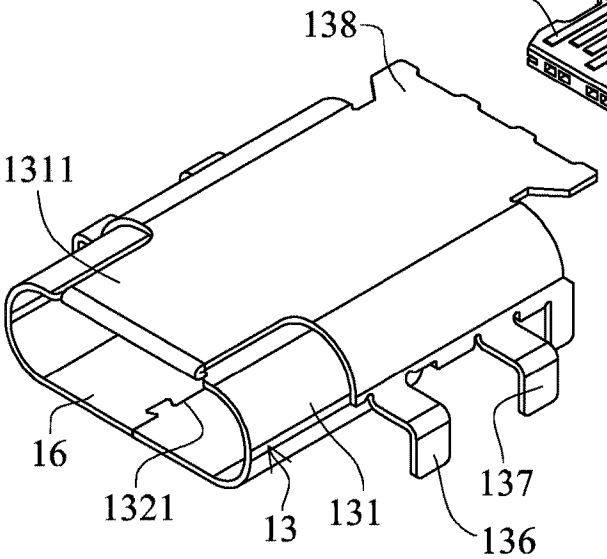
Figure 54:
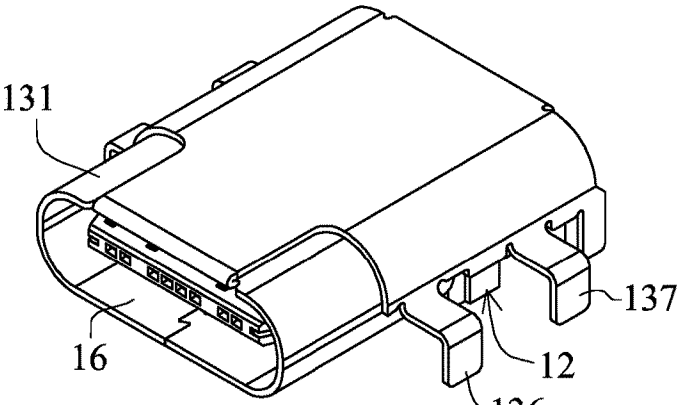
FIG. 54 is a pictorially assembled view according to the thirteenth embodiment of the invention.

Referring to FIGS. 53 and 54, the thirteenth embodiment of the invention is substantially the same as the twelfth embodiment except for the difference that the characteristic of this embodiment resides in that the reversely bent length of the reversely bent plate 1311 is longer and extends to stack over the rear section of top surface of the metal housing 13, wherein the reversely bent plate 1311 is integrally provided with the two second plate connecting members 137 disposed in back of the two first plate connecting members 136.

Figure 57:
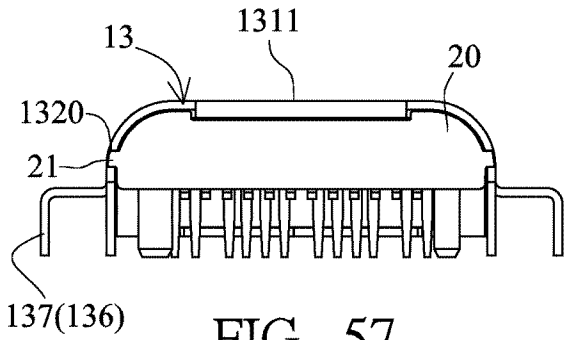
FIG. 57 is a rear view according to the 14th embodiment of the invention.
Figure 58:
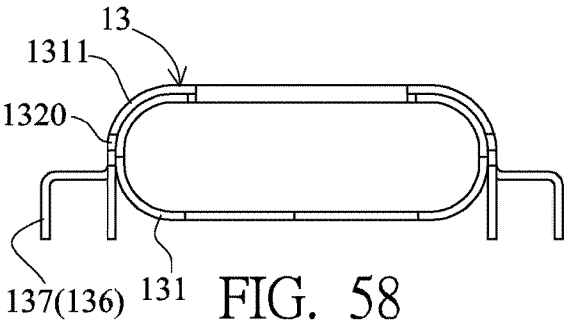
FIG. 58 is a rear view showing the metal housing according to the 14th embodiment of the invention.

Referring to FIGS. 55 to 58, the 14th embodiment of the invention is substantially the same as the eighth embodiment except for the difference that the characteristic of this embodiment resides in that the reversely bent plate 1311 is connected to top surface of the rear end of the metal housing 13, and the reversely bent plate 1311 is similarly integrally provided with the two first plate connecting members 136 and the two second plate connecting members 137. In addition, as shown in FIG. 57, the rear end of the metal housing 13 is assembled with and covered by a rear cover 20, the rear cover 20 shields the rear end of the insulated seat 12, and each of the left and right sides of the rear cover 20 is provided with a convex portion 21 locking to the engaging slot 1320 of the left and right sides of the rear end of the reversely bent plate 1311.

Figure 59:
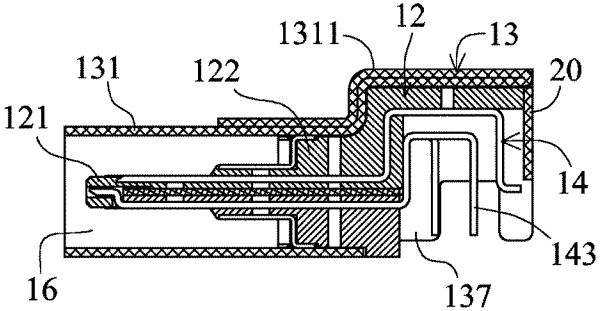
FIG. 59 is a cross-sectional side view according to the 15th embodiment of the invention.
Figure 56:
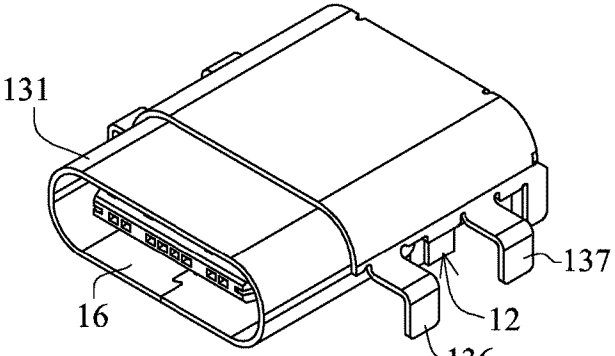
FIG. 56 is a pictorially assembled view according to the 14th embodiment of the invention.
Figure 55:
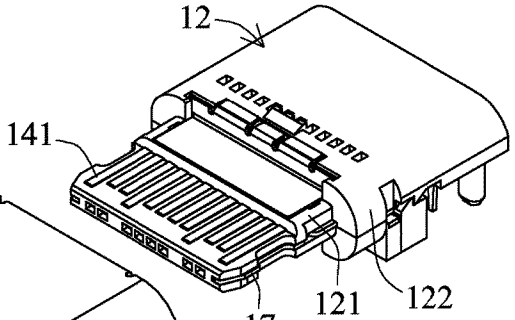
FIG. 55 is a stereoscopic exploded view according to the 14th embodiment of the invention.
Figure 55:
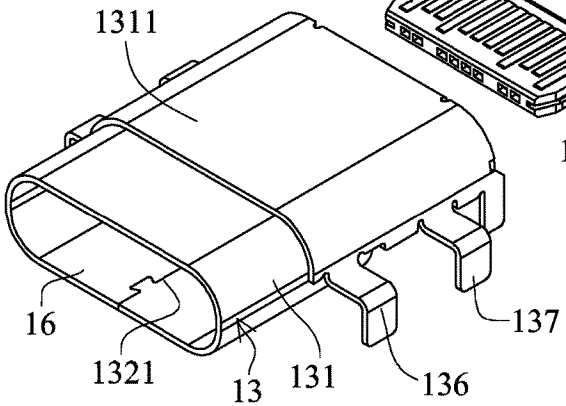

Referring to FIG. 59, the 15th embodiment of the invention is substantially the same as the 14th embodiment except for the difference that the connection slot 16 of this embodiment has the larger plate depressed level, and the base seat 122 of the insulated seat 12 is formed with a step, so the reversely bent plate 1311 of the metal housing 13 is also bent to form a step.

In addition, in the aspect of this embodiment, the reversely bent plate 1311 is also connected to the front end of the metal housing 13.

Each of the four-sided primary housings 131 according to the above-mentioned seventh to 15th embodiments may be similarly to the first embodiment and provided, on one surface, with a dove-tail shaped engaging sheet 1314 and an engaging slot 1315 combined and engaged with each other, wherein the connected two sides are applied with laser welding for hot melting and combining to form the gapless combination 1321.

Figure 60:
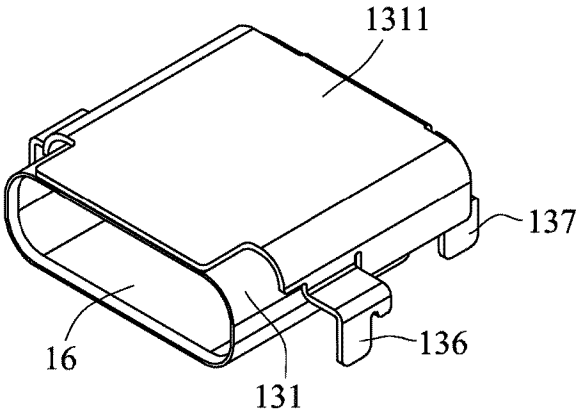
FIG. 60 is a pictorial view showing the metal housing according to the 16th embodiment of the invention.
Figure 61:
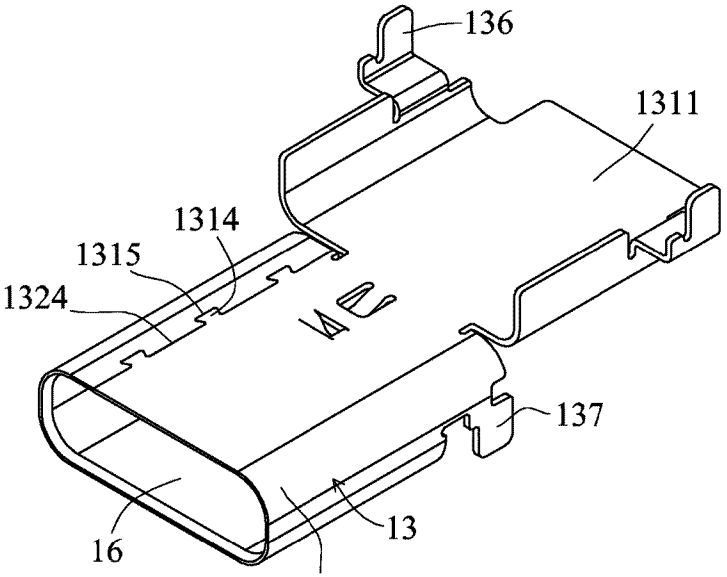
FIG. 61 is a pictorial view showing an opened reversely bent plate of the metal housing according to the 16th embodiment of the invention.

Referring to FIGS. 60 and 61, the 16th embodiment of the invention is substantially the same as the 14th embodiment except for the difference that the four-sided primary housing 131 of this embodiment is provided, on the top plate surface, with a dove-tail shaped engaging sheet 1314 and an engaging slot 1315 combined and engaged with each other, the connected two sides are only directly combined to form a minor seam 1324, and the reversely bent plate 1311 is connected to top surface of the rear end of the metal housing 13 to form a metal cover plate covering the top plate surface of the four-sided primary housing 131 and fully shielding the overall section of seam 1324 from the front end to the rear end.

Figure 63:
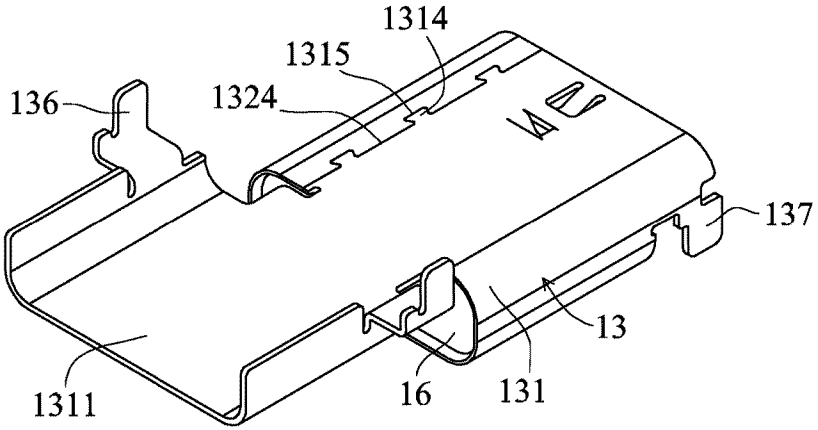
FIG. 63 is a pictorial view showing an opened reversely bent plate of the metal housing according to the 17th embodiment of the invention.
Figure 62:
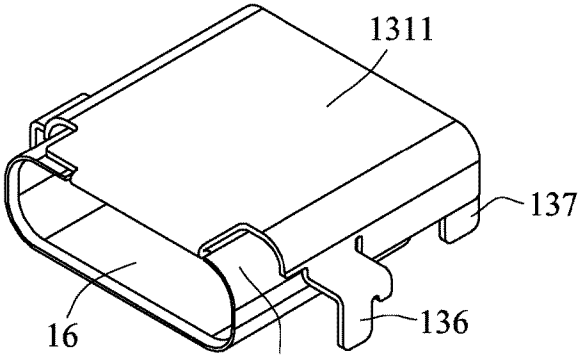
FIG. 62 is a pictorial view showing the metal housing according to the 17th embodiment of the invention.

Referring to FIGS. 62 and 63, the 17th embodiment of the invention is substantially the same as the 13th and 16th embodiments except for the difference that the four-sided primary housing 131 of this embodiment is provided, on the top plate surface, with a dove-tail shaped engaging sheet 1314 and an engaging slot 1315 combined and engaged with each other, the connected two sides are only directly combined to form a minor seam 1324, and the reversely bent plate 1311 is connected to top surface of the front end of the metal housing 13 to form a metal cover plate covering the top plate surface of the four-sided primary housing 131 and shielding the overall section of seam 1324 from the front end to the rear end shields to shield more than 85% of the seam 1324.

Figure 65:
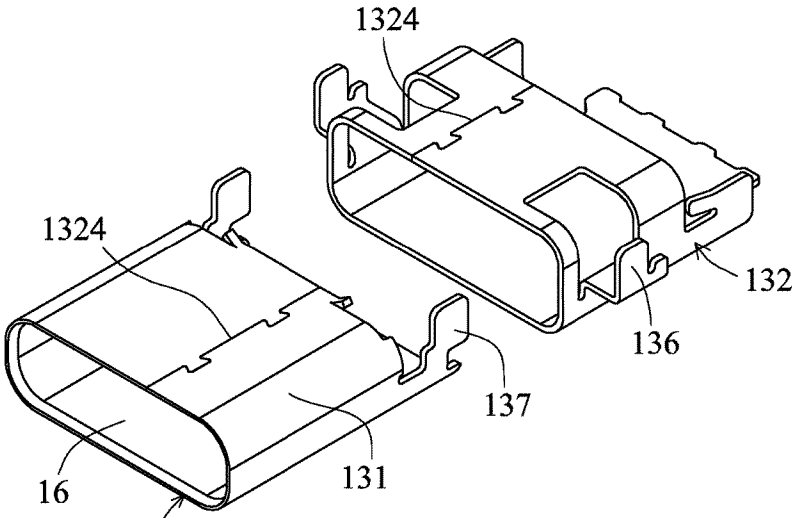
FIG. 65 is a stereoscopic exploded view showing the metal housing and the metal shell according to the 18th embodiment of the invention.
Figure 64:
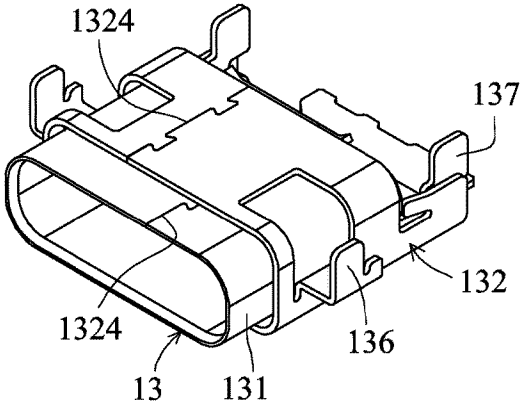
FIG. 64 is a pictorially assembled view showing the metal housing and the metal shell according to the 18th embodiment of the invention.

Referring to FIGS. 64 and 65, the 18th embodiment of the invention is substantially the same as the sixth embodiment except for the difference that the four-sided primary housing 131 of metal housing 131 and the four-sided housing 135 of the metal shell 132 of this embodiment are provided, on the same side, with dove-tail shaped engaging sheets and engaging slots combined and engaged with each other. The connected two sides are only directly combined to form a minor seam 1324, and the seam 1324 of the four-sided primary housing 131 and the seam 1324 of the four-sided housing 135 are mutually staggered in the left-right direction. Thus, a plate surface of the four-sided housing 135 is a metal cover plate, which can shield the seam 1324 of the four-sided primary housing 131.

Figure 66:
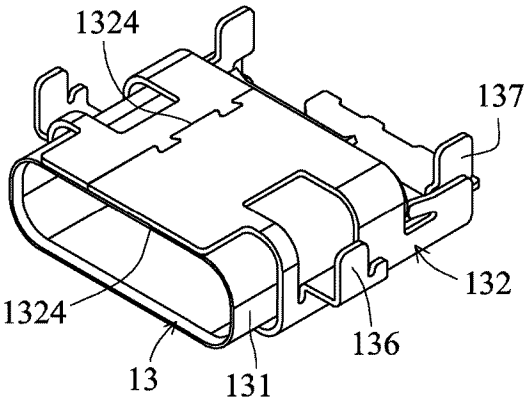
FIG. 66 is a pictorially assembled view showing the metal housing and the metal shell according to the 19th embodiment of the invention.

Referring to FIG. 66, the 19th embodiment of the invention is substantially the same as the 18th embodiment except for the difference that the front end of the connection surface of the four-sided housing 135 of the metal shell 132 of this embodiment is flush with the front end of the four-sided primary housing 131 to fully shield the overall section of seam 1324 of the four-sided primary housing 131 from the front end to the rear end.

Figure 67:
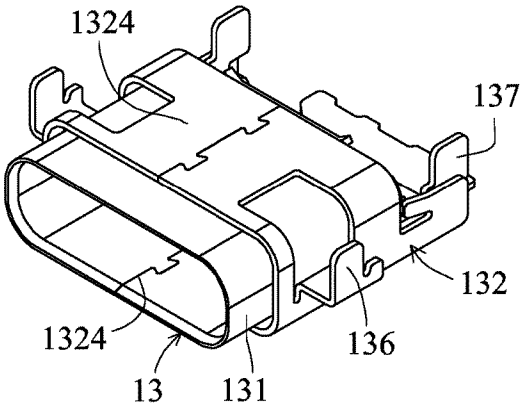
FIG. 67 is a pictorially assembled view showing the metal housing and the metal shell according to the 20th embodiment of the invention.

Referring to FIG. 67, the 20th embodiment of the invention is substantially the same as the 18th embodiment except for the difference that the seam 1324 of the four-sided primary housing 1316 of the metal housing 131 and the seam 1324 of the four-sided housing 135 of the metal shell 132 of this embodiment are disposed on different top and bottom plate surfaces, respectively, and the top plate surface of the four-sided housing 135 of the metal shell 132 can shield the seam 1324 of the top plate surface of the four-sided primary housing 131.

Figure 68:
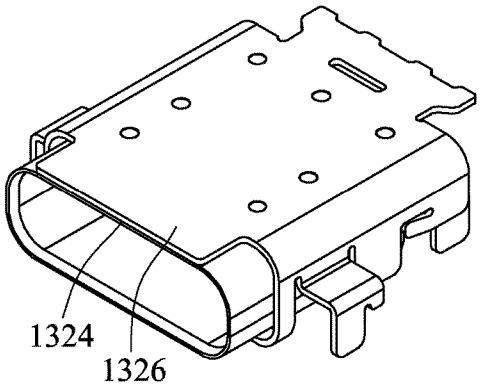
FIG. 68 is a pictorially assembled view showing the metal housing and the metal shell according to the 21st embodiment of the invention.

Referring to FIG. 68, the 21st embodiment of the invention is substantially the same as the 20th embodiment except for the difference that the front end of the top plate surface 1326 of the four-sided housing 135 of the metal shell 132 of this embodiment is flush with the front end of the four-sided primary housing 131 to fully shield the overall section of seam 1324 of the four-sided primary housing 131 from the front end to the rear end.

According to the descriptions of the sixth to 21st embodiments, the following advantages can be generalized.

1. The metal housing 13 is provided with first and second plate connecting members 136 and 137, arranged in front and back thereof, and can be stably positioned on a circuit board. In addition, the four-sided primary housing 1316 has no prodding hole to have the good shielding property, and to achieve the smaller electromagnetic compatibility coverage and electromagnetic interference (EMI) and the good electromagnetic susceptibility (EMS).

2. The metal housing 13 is assembled and filled with the metal housing 13 through the metal shell 132 to possess the good shielding property and also to be stably positioned on the circuit board, and can be easily manufactured and machined.

3. The metal housing 13 uses the integrally provided with reversely bent sheet 1311 to achieve to possess the good shielding property and also to be stably positioned on the circuit board, and can be easily manufactured and machined.

4. The connection surface of the four-sided primary housing 131 is the gapless combination 1321 to have the good shielding property.

5. Although the connection surface of the four-sided primary housing 131 has the seam 1324, most of the length of the seam 1324 is shielded to have the good shielding property.

Figure 70:
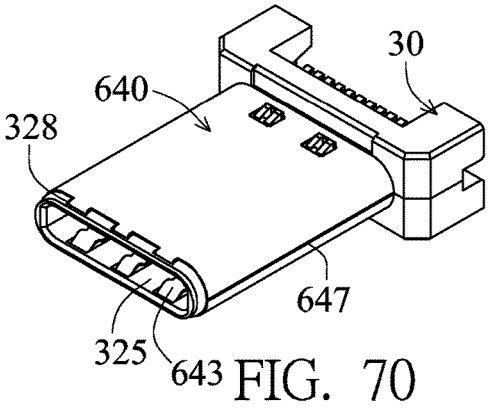
FIG. 70 is a pictorially assembled view according to the 22nd embodiment of the invention.
Figure 69:
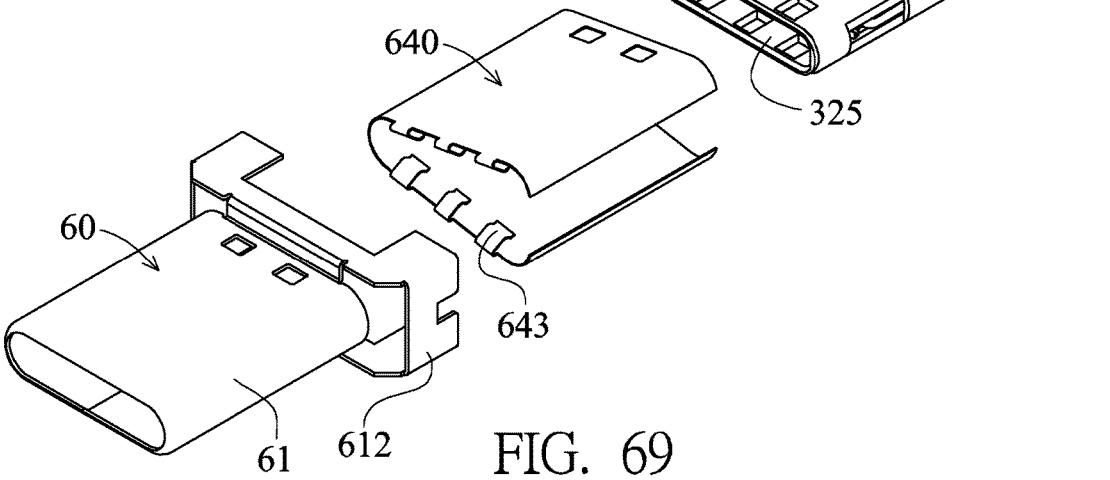
FIG. 69 is a stereoscopic exploded view according to the 22nd embodiment of the invention.

Referring to FIGS. 69 and 70, the 22nd embodiment of the invention is substantially the same as the plug of the first embodiment except for the difference that the left and right sides of the ground shielding member 640 of the this embodiment are connected together to form the seam 647, so that the opening 328 of the docking part 32 needs not to be disposed on the front end, and the docking part 32 may have the complete front edge.

Figure 71:
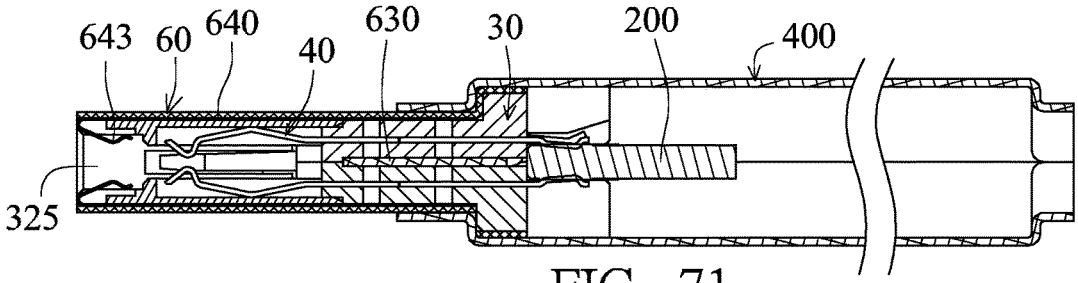
FIG. 71 is a cross-sectional side view according to the 23rd embodiment of the invention.

Referring to FIG. 71, the 23rd embodiment of the invention is substantially the same as the plug of the first embodiment except for the difference that the ground shielding member 640 of this embodiment is manufactured by way of pulling and extending.

Figure 72:
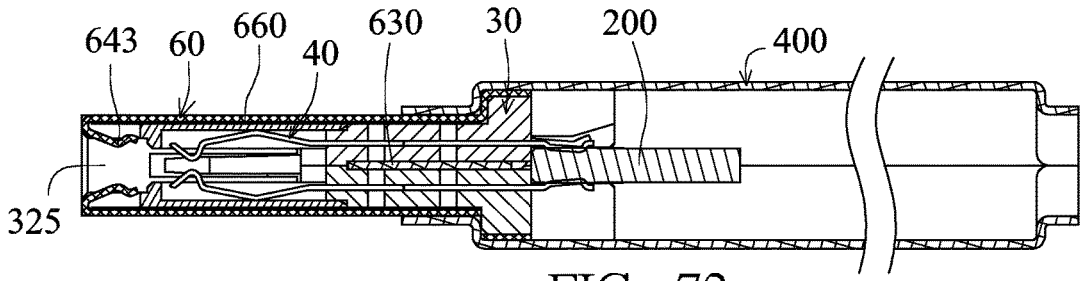
FIG. 72 is a cross-sectional side view according to the 24th embodiment of the invention.

Referring to FIG. 72, the 24th embodiment of the invention is substantially the same as the plug of the first embodiment except for the difference that the metal housing 60 of this embodiment direct functions as the ground shielding member, the top and bottom plate sheets thereof are two ground shielding sheets, each of the front ends of the two ground shielding sheets bent inwardly and reversely to form three elastic sheets, each of the three elastic sheets is bent to form a projecting contact 643 projects from the front section of the connection surface to the connection slot 325, the inside of the metal housing 60 is fitted with and rests against a metal shell 660, the metal shell 660 similarly is provided with a four-sided housing tightly fitted with the inside of the four-sided primary housing of the metal housing 60.

Figure 73:
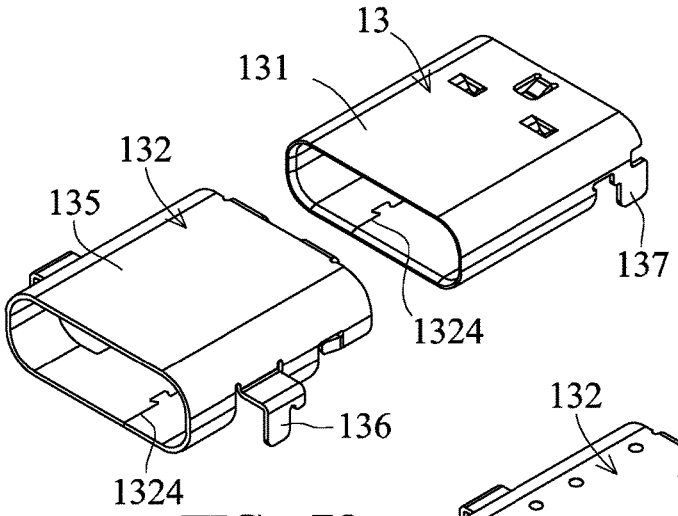
FIG. 73 is a stereoscopic exploded view showing the metal housing and the metal shell according to the 25th embodiment of the invention.
Figure 75:
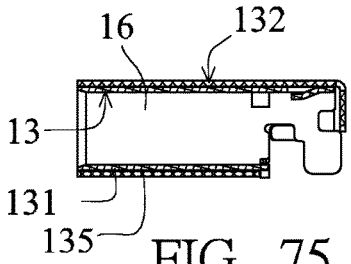
FIG. 75 is a cross-sectional side view showing the metal housing and the metal shell according to the 25th embodiment of the invention.
Figure 74:
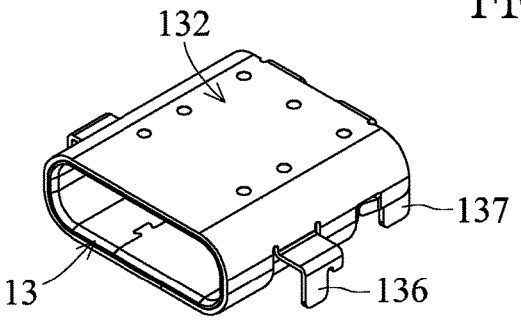
FIG. 74 is a pictorially assembled view showing the metal housing and the metal shell according to the 25th embodiment of the invention.

Referring to FIGS. 73 to 75, the 25th embodiment of the invention is substantially the same as the plug of the first embodiment except for the difference that both of the four-sided primary housing 131 of the metal housing 13 and the four-sided housing 135 of the metal shell 132 of this embodiment are substantially fitted with and flush with each other.

Figure 76:
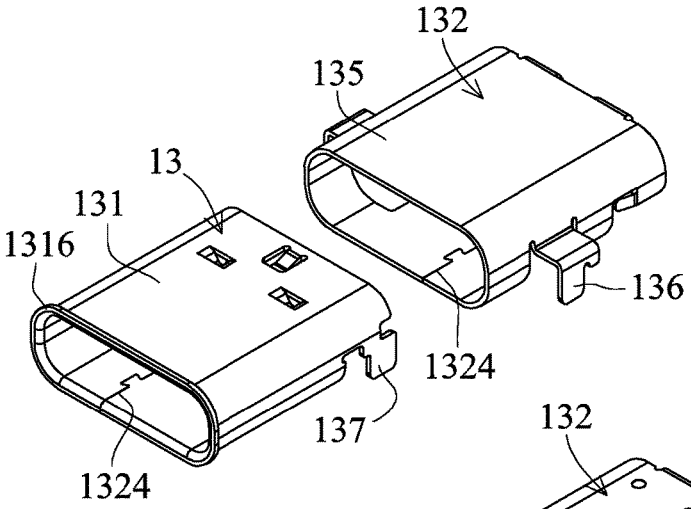
FIG. 76 is a stereoscopic exploded view showing the metal housing and the metal shell according to the 26th embodiment of the invention.
Figure 78:
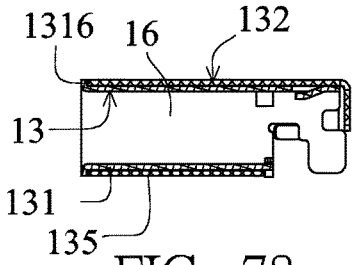
FIG. 78 is a cross-sectional side view showing the metal housing and the metal shell according to the 26th embodiment of the invention.
Figure 77:
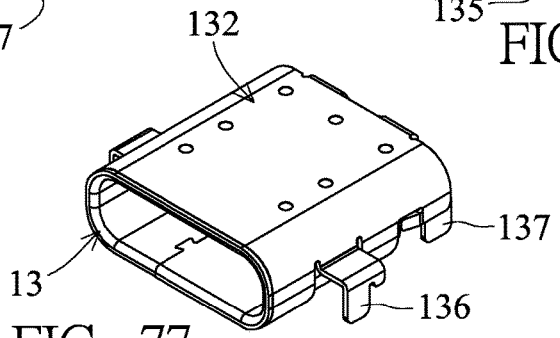
FIG. 77 is a pictorially assembled view showing the metal housing and the metal shell according to the 26th embodiment of the invention.

Referring to FIGS. 76 to 78, the 26th embodiment of the invention is substantially the same as the plug of the first embodiment and the 25th embodiment except for the difference that the front end 1316 of the metal housing 13 of this embodiment is bent outwardly to shield the front end of the four-sided housing 135 of the metal shell 132.

Figure 79:
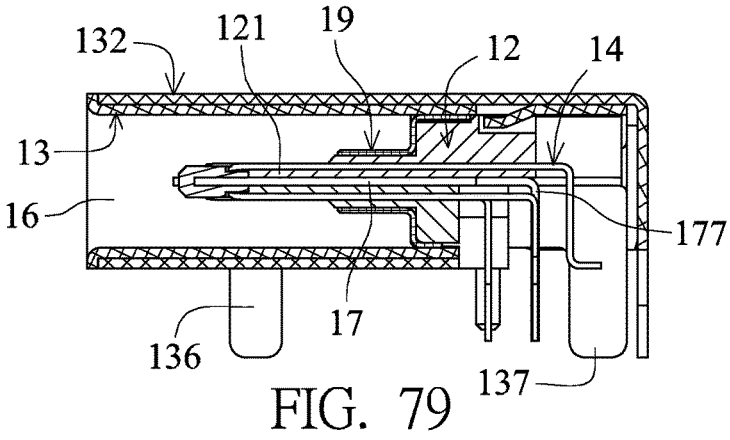
FIG. 79 is a cross-sectional side view according to the 27th embodiment of the invention.

Referring to FIG. 79, the 27th embodiment of the invention is substantially the same as the plug of the first embodiment and the 26th embodiment except for the difference that this embodiment is of the on-board type. That is, the metal shell 132 is in flat surface contact with the circuit board.

Figure 80:
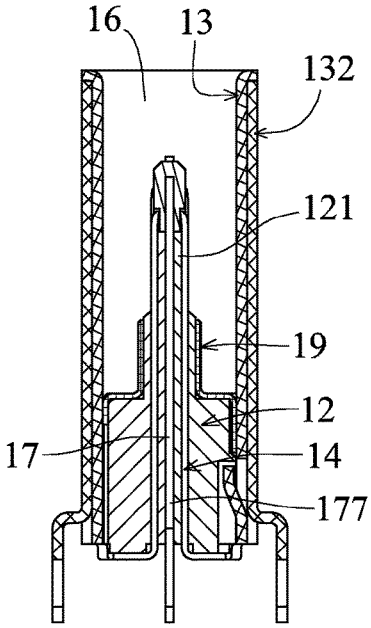
FIG. 80 is a cross-sectional side view according to the 28th embodiment of the invention.

Referring to FIG. 80, the 28th embodiment of the invention is substantially the same as the plug of the first embodiment and the 26th embodiment except for the difference that this embodiment is of a vertical type. That is, the insert port of the connection slot 16 faces upwards, and the tongue 121 extends upwardly and vertically.

Figure 81:
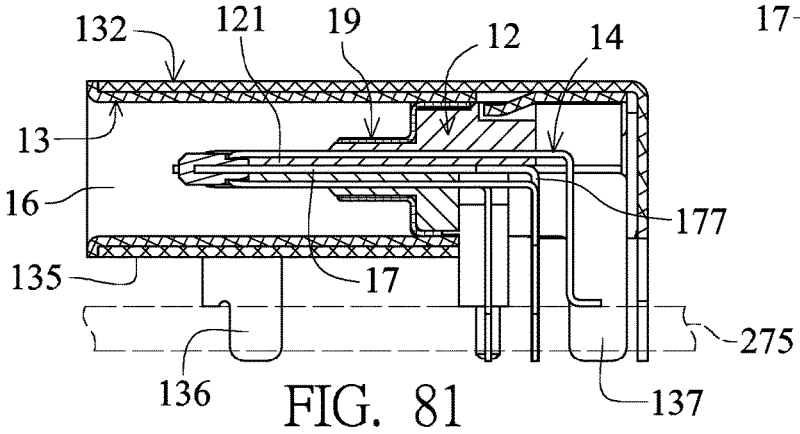
FIG. 81 is a cross-sectional side view according to the 29th embodiment of the invention.

Referring to FIG. 81, the 29th embodiment of the invention is substantially the same as the plug of the first embodiment and the 26th embodiment except for the difference that this embodiment is of the float-board type. That is, the metal shell 132 floats over the circuit board 275 with a vertical gap therebetween.

Figure 82:
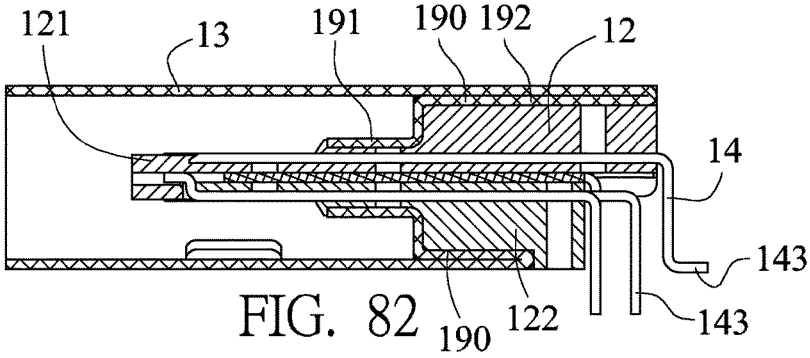
FIG. 82 is a cross-sectional side view according to the 30th embodiment of the invention.

Referring to FIG. 82, the 30th embodiment of the invention is substantially the same as the plug of the first embodiment except for the difference that each of the rear ends of the top and bottom plates of the metal housing 13 of this embodiment is integrally and inwardly provided with a reversely bent plate, the two reversely bent plate s are two ground shielding sheets 190, the ground shielding sheet 190 is in the form of the ladder shape of first and second plate sheets 191 and 192, the two second plate sheets 192 is in flat surface contact with the outer side of the base seat 122 and stacked on the inner surfaces of the top and bottom plates of the metal housing 13, and the two first plate sheets 191 is in flat surface contact with the grounding convex surfaces of the rear sections of the two connection surfaces of the tongue 121. Because the two ground shielding sheets 190 are integrally provided with the metal housing 13, the two ground shielding sheets 190 may be regarded as similar to the first embodiment and as an integral ground shielding member, wherein the two ground shielding sheets 190 of the integral ground shielding member and the metal housing 13 have the same material thickness.

Figure 83:
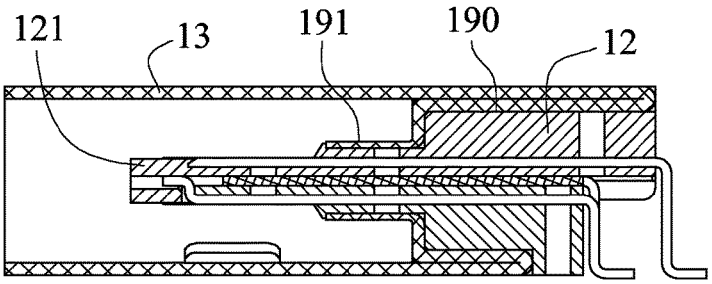
FIG. 83 is a cross-sectional side view according to the 31st embodiment of the invention.

Referring to FIG. 83, the 31st embodiment of the invention is substantially the same as the 30th embodiment except for the difference that the first plate sheets 191 of the two ground shielding sheets 190 are thinned o form the smaller thickness.

Referring to FIGS. 84 and 85, the 32nd embodiment of the invention is a bidirectional duplex USB TYPE-C electrical connection plug and is substantially the same as the 24th embodiment except for the difference that the metal housing 60 of this embodiment similarly functions as the ground shielding member, the top and bottom plate sheets thereof are two ground shielding sheets, the plate surfaces of the front sections of the two ground shielding sheets are prodded to bent inwardly and reversely to form three elastic sheets 650, and each of the three elastic sheets 650 projects to form a contact 643 projecting from the front section of the connection surface to the connection slot 325. However, the inside of the metal housing 60 is no longer fitted with and rests against a metal shell. Each of the top and bottom surfaces of the docking part 32 is provided with two openings 328 extending from the rear end to the portion near the front end to provide the spaces for the contact 654 to project beyond the connection slot 325, and the front end of the docking part 32 is provided with a projecting ring 324 and is flush with the metal housing 60.

Referring to FIGS. 86 and 87, the 33rd embodiment of the invention is substantially the same as the 33rd embodiment except for the difference that the docking part 32 of this embodiment is assembled with the metal housing 60 from rear to front. So, the front end of the docking part 32 has no projecting ring, and the opening 328 is disposed on the front end.

Figure 88:
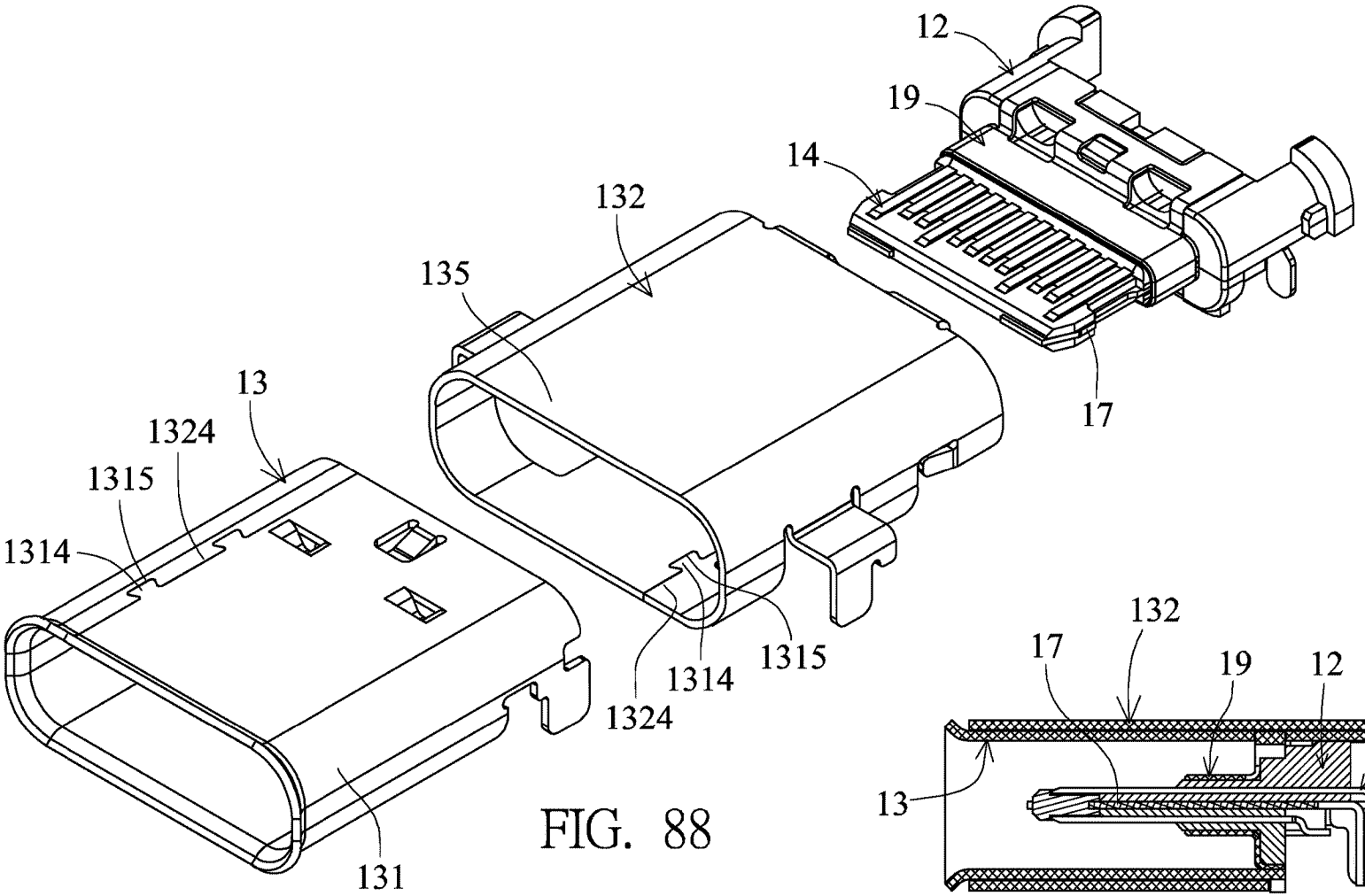
FIG. 88 is a stereoscopic exploded view according to the 34th embodiment of the invention.
Figure 89:
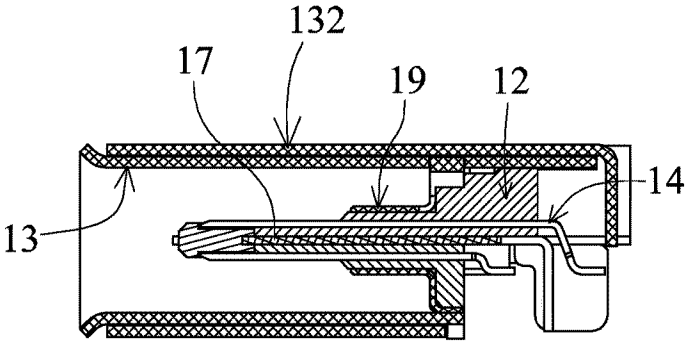
FIG. 89 is a cross-sectional side view according to the 34th embodiment of the invention.

Referring to FIGS. 88 and 89, the 34th embodiment of the invention is substantially the same as the plug of the first embodiment and the 25th embodiment except for the difference that the seam 1324 of the four-sided primary housing 131 of the metal housing 13 of this embodiment is disposed on the top plate surface and close to the left side, and the seam 1324 of the four-sided housing 135 of the metal shell 132 is disposed on the bottom plate surface and close to the right side, so that the seams 1324 of both of them are disposed on different surfaces and staggered in the left-right direction. In addition, the metal housing 13 and the metal shell 132 are formed by bending the metal plate sheets having the same thickness, so both of them have the same structural strength and can support each other and mutually shield the seam 1324. Because both of them have the same structural strength, both of them have the averaged endurance, and the overall product needs not to be discarded due to the damage of one single part.

Figures 90, 91, 92, 93:
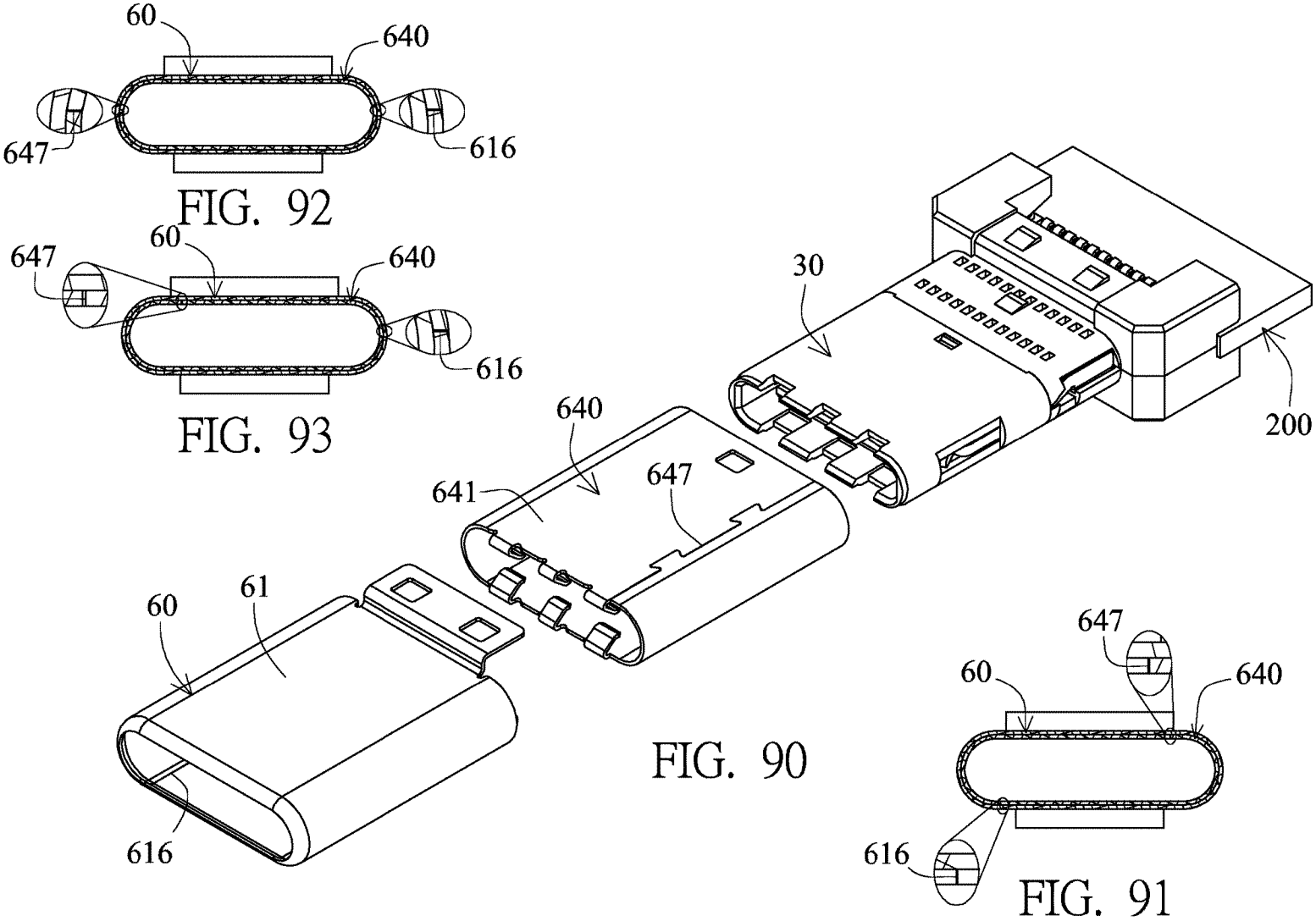
FIG. 90 is a stereoscopic exploded view according to the 35th embodiment of the invention.
FIG. 91 is an assembled front view of the metal housing and the ground shielding member according to the 35th embodiment of the invention.
FIG. 92 is an assembled front view of the metal housing and the ground shielding member according to the 36th embodiment of the invention.
FIG. 93 is an assembled front view of the metal housing and the ground shielding member according to the 37th embodiment of the invention.

Referring to FIGS. 90 and 91, the 35th embodiment of the invention is substantially the same as the plug of the first embodiment except for the difference that the seam 616 of the four-sided primary housing 61 of the metal housing 60 of this embodiment is disposed on the bottom plate surface and close to the left side, and the seam 647 of the four-sided housing of the ground shielding member 640 (also functions as the metal shell) is disposed on the top plate surface and close to the right side, so that the seams 616 and 647 of both of them are disposed on different surfaces and staggered in the left-right direction. In addition, the metal housing 60 and the ground shielding member 640 are formed by bending the metal plate sheets having the same thickness, so both of them have the same structural strength, can support each other and mutually shield the seams 616 and 647. Because both of them have the same structural strength, both of them have the averaged endurance, and the overall product needs not to be discarded due to the damage of one single part.

Referring to FIG. 92, the 36th embodiment of the invention is substantially the same as the 35th embodiment except for the difference that the seam 616 of the four-sided primary housing 61 of the metal housing 60 of this embodiment is disposed on the right side plate surface, and the seam 647 of the four-sided housing of the ground shielding member 640 (also functions as the metal shell) is disposed on the left side plate surface.

Referring to FIG. 93, the 37th embodiment of the invention is substantially the same as the 35th embodiment except for the difference that the seam 616 of the four-sided primary housing 61 of the metal housing 60 of this embodiment is disposed on the right side plate surface, and the seam 647 of the four-sided housing of the ground shielding member 640 (also functions as the metal shell) is disposed on the left side plate surface.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A reversible dual-position electric connector, comprising:

an insulated seat provided with a base seat and one docking part, wherein the docking part is disposed on one end of the base seat and is provided with two connection surfaces facing opposite directions;

two terminal sets disposed on the insulated seat, wherein each of the terminal sets is provided with at least one row of terminals, the terminal has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing having four plate surfaces integrally connected together, wherein the four-sided primary housing shields the docking part to form one docking structure;

characterized in that a metal shell is further provided to rest against the metal housing, the metal shell is provided with a four-sided housing, the four-sided housing has four plate surfaces integrally connected together, the four plate surfaces of the four-sided housing are directly fitted with and contact the four plate surfaces of the four-sided primary housing, and the four plate surfaces of one of the four-sided primary housing and the four-sided housing have no prodding hole facing the docking part, wherein the docking part is a tongue, the tongue is projectingly disposed on the end of the base seat, an inner end of the tongue is connected to the base seat, an outer end of the tongue is a free end, plate surfaces of the tongue with two larger areas are the two connection surfaces, two opposite sides of the tongue opposite to the inner and outer ends are two sides, the metal housing and the base seat rest against and are positioned with each other, a connection slot is formed in the four-sided primary housing, the tongue is disposed at a middle height of the connection slot, a docking electric connector can be inserted and positioned into the connection slot in a dual-position bidirectional manner, and the four-sided housing is tightly fitted with an outside of the four-sided primary housing.

2. The reversible dual-position electric connector according to claim 1, characterized in that the electric connector satisfies one of (a) to (d) or a combination of more than one of (a) to (d):

(a) wherein the four plate surfaces of the four-sided primary housing has no prodding hole facing the docking part;

(b) wherein a shape of the docking structure can be positioned at the docking electric connector in a reversible dual-position manner;

(c) wherein the four plate surfaces of each of both of the four-sided primary housing and the four-sided housing has no prodding hole facing the docking part; and (d) wherein one or each of a set of the four plate surfaces of the four-sided primary housing and a set of the four plate surfaces of the four-sided housing has top and bottom flat surfaces and left and right arced plate surfaces.

3. The reversible dual-position electric connector according to claim 1, characterized in that the two connection surfaces of the tongue are horizontal and extend frontwards, an inlet of the connection slot faces frontwards, the outer end of the tongue is a front end of the tongue, left and right sides of a rear section of the metal housing are integrally provided with two plate connecting members extending downwards, and the two plate connecting members can be connected to and positioned at a circuit board.

4. A reversible dual-position electric connector, comprising:

an insulated seat provided with a base seat and one docking part, wherein the docking part is disposed on one end of the base seat and is provided with two connection surfaces facing opposite directions;

two terminal sets disposed on the insulated seat, wherein each of the terminal sets is provided with at least one row of terminals, the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner;

characterized in that the docking part is a tongue, the tongue is projectingly disposed on the end of the base seat, an inner end of the tongue is connected to the base seat, an outer end of the tongue is a free end, plate surfaces of the tongue with two larger areas are the two connection surfaces, two opposite sides of the tongue opposite to inner and outer ends are two sides, the metal housing and the base seat rest against and are positioned with each other, a connection slot is formed in the four-sided primary housing, the tongue is disposed at a middle height of the connection slot, the docking electric connector can be inserted and positioned into the connection slot in a dual-position bidirectional manner, and a ground shielding member resting against the metal housing is further provided, wherein the ground shielding member comprises two ground shielding sheets, each of which are provided by integrally bending a metal plate sheet to form a gap between the two ground shielding sheets, the two ground shielding sheets are provided with first plate sheets covering two inner sections of the two connection surfaces of the tongue, respectively, at least one ground shielding sheet is provided with a second plate sheet forming a step together with the first plate sheet, the second plate sheet covers the base seat and is electrically connected to the metal housing, and the second plate sheet has no resilient convex portion resiliently resting against the metal housing.

5. A reversible dual-position electric connector, comprising:

an insulated seat provided with a base seat and one docking part, wherein the docking part is disposed on one end of the base seat and is provided with two connection surfaces facing opposite directions;

two terminal sets disposed on the insulated seat, wherein each of the terminal sets is provided with at least one row of terminals, the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner;

characterized in that the docking part is provided with two connection plates facing each other in a top-to-bottom direction, a connection slot is formed between the two connection plates, opposite surfaces of the two connection plates are the two connection surfaces, and a ground shielding member resting against an inside of the metal housing is further provided, wherein the ground shielding member comprises two ground shielding sheets integrally provided with a gap between the two ground shielding sheets, the two ground shielding sheets are provided with at least two resilient contacts shielding outsides of the two connection plates, respectively, and the contacts of the two ground shielding sheets project beyond the two connection surfaces, respectively.

6. The reversible dual-position electric connector according to claim 5, characterized in that the ground shielding member has a four-sided housing and is in the form of a metal shell, top and bottom plate sheets of the four-sided housing are the two ground shielding sheets, and the four-sided housing is fitted with and rests against the four-sided primary housing.

7. The reversible dual-position electric connector according to claim 1, characterized in that the electric connector satisfies one of (a) to (e) or a combination of more than one of (a) to (e):

(a) wherein the four-sided primary housing and the four-sided housing are substantially fitted with and flush with each other;

(b) wherein the four-sided primary housing and the four-sided housing are substantially fitted with and flush with each other, and a front end of the four-sided primary housing is bent to shield a front end of the four-sided housing;

(c) wherein one or each of the four-sided primary housing and the four-sided housing is formed by bending a metal plate sheet and combined and locked together on a plate surface;

(d) wherein each of the four-sided primary housing and the four-sided housing are formed by bending a metal plate sheet and is combined together on a plate surface to form a seam, wherein the two seams are staggered; and (e) wherein a front end of the four-sided primary housing projects frontward much more than a front end the four-sided housing.

8. The reversible dual-position electric connector according to claim 1, characterized in that each of the four-sided primary housing and the four-sided housing is formed by bending a metal plate sheet and is combined and locked together on a plate surface to form a seam, and the metal plate sheets of the four-sided primary housing and the four-sided housing have the same thickness.

9. The reversible dual-position electric connector according to claim 8, characterized in that the electric connector satisfies one of (a) to (c):

(a) wherein the seams of the four-sided primary housing and the four-sided housing are biased toward different sides and staggered in a left-right direction;

(b) wherein the seams of the four-sided primary housing and the four-sided housing are disposed on two surfaces, which are not mutually stacked; and (c) wherein the seams of the four-sided primary housing and the four-sided housing are biased toward different sides and staggered in a left-right direction and disposed on two surfaces, which are not mutually stacked.

10. The reversible dual-position electric connector according to claim 1, characterized in that the four-sided housing integrally extends downwardly to provide at least one first plate connecting member disposed on left and right sides of the four-sided primary housing, and the first plate connecting member can be connected to and positioned on a circuit board.

11. The reversible dual-position electric connector according to claim 10, characterized in that the electric connector satisfies one of (a) to (h) or a combination of more than one of (a) to (h):

(a) wherein the metal housing is backward extended with an engaging combining plate on a top end of the four-sided primary housing, and the engaging combining plate is in flat surface contact with an inner surface of a top end of the metal shell and locks to the base seat of the insulated seat;

(b) wherein a stopping structure is provided between the metal shell and the metal housing to stop the metal shell from moving frontwards;

(c) wherein a stopping structure is provided between the metal shell and the metal housing to stop the metal shell from moving backwards;

(d) wherein there are two of the first plate connecting members, which are left-right symmetrical;

(e) wherein there are two of the first plate connecting members, which are left-right symmetrical, two left-right symmetrical second plate connecting members are further provided in back of the two first plate connecting members, the two second plate connecting members can be connected to and positioned on the circuit board, and the two second plate connecting members are integrally disposed on the metal housing;

(f) wherein there are two of the first plate connecting members, which are left-right symmetrical, two left-right symmetrical second plate connecting members are further provided in back of the two first plate connecting members, the two second plate connecting members can be connected to and positioned on the circuit board, and the two second plate connecting members integrally is disposed on the metal shell;

(g) wherein the at least one first plate connecting member is formed by prodding, pressing and bending at least one plate surface of the four-sided housing, and the at least one plate surface of the four-sided housing is formed with at least one prodding hole; and (h) wherein the front end of the four-sided housing is integrally provided with a reversely bent plate, the reversely bent plate is stacked outside a top surface of the four-sided housing, and the reversely bent plate integrally extends downwardly to provide the at least one first plate connecting member.

12. The reversible dual-position electric connector according to claim 5, characterized in that the ground shielding member and the metal housing are integrally in the form of a four-sided housing, and top and bottom plate sheets of the four-sided housing are the two ground shielding sheets.

13. The reversible dual-position electric connector according to claim 5, characterized in that the two ground shielding sheets are combined with an outside of the two connection plates, and the two connection plates are provided with openings, through which the contacts of the two ground shielding sheets pass and are exposed from the two connection surfaces.

14. The reversible dual-position electric connector according to claim 13, characterized in that the electric connector satisfies one of (a) to (d) or a combination of more than one of (a) to (d):

(a) wherein the contacts of the two ground shielding sheets project beyond the two connection surfaces, respectively, and are vertically elastically movable;

(b) wherein the contacts of the two ground shielding sheets are formed by reversely projectingly bending an elastic sheet from a front end, and the contacts of the two ground shielding sheets project beyond the two connection surfaces, respectively, and are vertically elastically movable;

(c) wherein the two connection surfaces have two front sections and two rear sections higher than the two front sections, so that the connection slot forms a front section and a rear section lower than the front section, the contacts of the two ground shielding sheets are exposed from the front sections of the two connection surfaces, respectively, and the contacts of the two terminal sets are exposed from the rear sections of the two connection surfaces, respectively, and are closer to a middle height of the connection slot than the contacts of the two ground shielding sheets; and (d) wherein each of the terminals of the two terminal sets is provided with a vertically elastically movable extension, the extension extends out of and is disposed in front of the base seat, and is provided with the contact, the docking part is in the form of a fitting member of a fitting frame body fitted with a front end of the base and covers the extensions of the terminals of the two terminal sets, the contacts of the terminals of the two terminal sets project beyond the two connection surfaces, respectively, and are vertically elastically movable together with the extension, and front ends or portions near the front ends of the two connection plates of the fitting member are provided with openings, through which the contacts of the two ground shielding sheets pass, project beyond the two connection surfaces and are vertically elastically movable.

15. The reversible dual-position electric connector according to claim 4, characterized in that the ground shielding member has a four-sided housing, and the four-sided housing is fitted with and positioned at the insulated seat.

16. The reversible dual-position electric connector according to claim 15, characterized in that the electric connector satisfies one of (a) to (g) or a combination of more than one of (a) to (g):

(a) wherein the four-sided housing is formed with the first plate sheet of the two ground shielding sheets, and the four-sided housing is fitted with and positioned at the inner section of the tongue;

(b) wherein the four-sided housing is formed with the first plate sheet of the two ground shielding sheets, the four-sided housing is fitted with and positioned at an inner section of the tongue, the insulated seat middle is provided with a metal partition plate, the metal partition plate extends from the base seat to the tongue and separates the contacts of the two terminal sets, two sides of the metal partition plate are provided with laterally projecting convex portions, and the two side plates of the four-sided housing contact the convex portions of the two sides of the metal partition plate;

(c) wherein the two ground shielding sheets are provided with the second plate sheet;

(d) wherein a thickness of the tongue is such that an inner section is thicker than an outer section so that the inner sections of the two connection surfaces are much more projecting than the outer sections of the two connection surfaces project;

(e) wherein the two ground shielding sheets are provided with the second plate sheets, the four-sided housing is formed with the second plate sheet of the two ground shielding sheets, and the four-sided housing is fitted with and positioned at the base seat;

(f) wherein the second plate sheet has a negative angle leaning against the metal housing, and the second plate sheet rests against the metal housing in an overpressure manner; and (g) wherein the second plate sheet is in the form of a smooth plate sheet.

17. The reversible dual-position electric connector according to claim 5, characterized in that the electric connector satisfies one of (a) to (e) or a combination of more than one of (a) to (e):

(a) wherein a rear end of the base seat of the insulated seat is provided with a circuit board and an electronic unit, the pins of the two terminal sets and the electronic unit are electrically connected to the circuit board, and the pins of the two terminal sets are electrically connected to the electronic unit through the circuit board;

(b) wherein the two connection plates have the same height;

(c) wherein a cover body covering a rear section of the metal housing is further provided;

(d) wherein a middle of the base seat of the insulated seat is provided with a metal partition plate, the metal partition plate separates the two terminal sets, each of two sides of the metal partition plate is integrally provided with a resilient snap, and the two resilient snaps are elastically movable in a left-right direction and have portions near two free ends provided with two laterally inwardly projecting snapping convex portions disposed on two sides of the connection slot, respectively; and (e) wherein a middle of the base seat of the insulated seat is provided with a metal partition plate, the metal partition plate separates the two terminal sets, each of two sides of the metal partition plate is integrally provided with a resilient snap, the two resilient snaps are elastically movable in a left-right direction and have portions near two free ends provided with two laterally inwardly projecting snapping convex portions disposed on two sides of the connection slot, respectively, and the metal partition plate is provided with at least one pin for electrical connection to form a grounding mask.

18. The reversible dual-position electric connector according to claim 5, characterized in that the docking part is provided with two side plates connected to the two connection plates to form a fitting frame body.

19. The reversible dual-position electric connector according to claim 18, characterized in that each of the terminals of the two terminal sets is provided with a vertically elastically movable extension, the extension extends out of and is disposed in front of the base seat and is provided with the contact, the docking part is a fitting member fitted with a front end of the base and covering the extensions of the terminals of the two terminal sets, and the contacts of the terminals of the two terminal sets project beyond the two connection surfaces, respectively, and are vertically elastically movable together with the extensions.

20. The reversible dual-position electric connector according to claim 19, characterized in that the electric connector satisfies one of (a) to (c) or a combination of more than one of (a) to (c):

(a) wherein the two connection plates of the fitting member are provided with separate barriers to form separate slots for separating the extensions of the terminals of the two terminal sets;

(b) wherein a jointing portion connected to the fitting member is disposed in front of the base seat, the jointing portion has only two sides arced and has a middle section in the form of a notch; and (c) wherein a middle of the base seat of the insulated seat is provided with a metal partition plate, the metal partition plate separates the two terminal sets, each of two sides of the metal partition plate is integrally provided with a resilient snap, the two resilient snaps are elastically movable in a left-right direction and have portions near two free ends provided with two laterally inwardly projecting snapping convex portions disposed on two sides of the connection slot, respectively, each of two sides of the fitting member is provided with an opening, and when the two resilient snaps elastically move in the left-right direction, the two openings provide the spaces for the two resilient snaps.

21. The reversible dual-position electric connector according to claim 4, characterized in that the electric connector satisfies one of (a) to (k) or a combination of more than one of (a) to (k):

(a) wherein each of the two ground shielding sheets is provided with the second plate sheet;

(b) wherein the second plate sheet has a negative angle leaning against the metal housing, and the second plate sheet rests against the metal housing in an overpressure manner;

(c) wherein the second plate sheet is in the form of a smooth plate sheet:

(d) wherein an external shape of the connection slot is top-bottom symmetrical and left-right symmetrical, the tongue is disposed at a middle height of the connection slot, and the two connection surfaces of the tongue form two symmetrical spaces;

(e) wherein a thickness of the base seat is larger than that of the tongue;

(f) wherein the contacts of the two terminal sets are in flat surface contact with the connection surfaces of the tongue and are elastically non-movable;

(g) wherein the contacts of the two terminal sets are in flat surface contact with and fixed to the two connection surfaces of the tongue, respectively, and are elastically non-movable, the contacts of the two terminal sets are arranged in two rows with different lengths, and the lengths of the contacts of the two terminal sets are reversely and correspondingly arranged;

(h) wherein each of the two terminal sets has one row of 12 terminals and the contacts are elastically non-movable;

(i) wherein the two connection surfaces of the tongue are horizontal and extend frontwards, an inlet of the connection slot faces frontwards, the outer end of the tongue is a front end of the tongue; or wherein the two connection surfaces of the tongue are vertical and extend upwards, and an inlet of the connection slot faces upwards; or wherein the two connection surfaces of the tongue are vertical and extend frontwards, and an inlet of the connection slot faces frontwards;

(j) wherein the insulated seat is provided with a first seat and a second seat mutually stacked, the two terminal sets are respectively embedded into and injection molded with the first and second seat, the first base is integrally formed with a first tongue and a first base seat, the second base is integrally formed with a second tongue and a second base seat, the tongue comprises the first and second tongues stacked together, and the first and second base seat are stacked to form the base seat; and (k) wherein a middle of the insulated seat is positioned and provided with a metal partition plate, the metal partition plate extends from the base seat to the tongue, each of two sides of the outer sections of the metal partition plate is provided with an engaging slot, and each of two sides of the tongue is provided with slot corresponding to the engaging slot.

22. The reversible dual-position electric connector according to claim 1, characterized in that the electric connector satisfies one of (a) to (h) or a combination of more than one of (a) to (h):

(a) wherein an external shape of the connection slot is top-bottom symmetrical and left-right symmetrical, the tongue is disposed at a middle height of the connection slot, and the two connection surfaces of the tongue form two symmetrical spaces;

(b) wherein a thickness of the base seat is larger than that of the tongue;

(c) wherein the contacts of the two terminal sets are in flat surface contact with the connection surfaces of the tongue and are elastically non-movable;

(d) wherein the contacts of the two terminal sets are in flat surface contact with and fixed to the two connection surfaces of the tongue, respectively, and are elastically non-movable, the contacts of the two terminal sets are arranged in two rows with different lengths, and the lengths of the contacts of the two terminal sets are reversely and correspondingly arranged;

(e) wherein each of the two terminal sets has one row of 12 terminals and the contacts are elastically non-movable;

(f) wherein the two connection surfaces of the tongue are horizontal and extend frontwards, an inlet of the connection slot faces frontwards, the outer end of the tongue is a front end of the tongue; or wherein the two connection surfaces of the tongue are vertical and extend upwards, and an inlet of the connection slot faces upwards; or wherein the two connection surfaces of the tongue are vertical and extend frontwards, and an inlet of the connection slot faces frontwards;

(g) wherein the insulated seat is provided with a first seat and a second seat mutually stacked, the two terminal sets are respectively embedded into and injection molded with the first and second seat, the first base is integrally formed with a first tongue and a first base seat, the second base is integrally formed with a second tongue and a second base seat, the tongue comprises the first and second tongues stacked together, and the first and second base seat are stacked to form the base seat; and (h) wherein a middle of the insulated seat is positioned and provided with a metal partition plate, the metal partition plate extends from the base seat to the tongue, each of two sides of the outer sections of the metal partition plate is provided with an engaging slot, and each of two sides of the tongue is provided with slot corresponding to the engaging slot.

23. A reversible dual-position electric connector, comprising:

an insulated seat provided with a base seat and one docking part, wherein the docking part is disposed on one end of the base seat and is provided with two connection surfaces facing opposite directions;

two terminal sets disposed on the insulated seat, wherein each of the terminal sets is provided with at least one row of terminals, the terminals has one end extending to provide a contact and the other end extending to provide a pin, and the contacts of the two terminal sets are exposed from the two connection surfaces of the docking part, respectively; and a metal housing, which covers the insulated seat and is provided with a four-sided primary housing, wherein the four-sided primary housing shields the docking part to form one docking structure, and a shape of the docking structure can be positioned at one docking electric connector in a reversible dual-position manner;

characterized in that the docking part is a tongue, the tongue is projectingly disposed on the end of the base seat, an inner end of the tongue is connected to the base seat, an outer end of the tongue is a free end, plate surfaces of the tongue with two larger areas are the two connection surfaces, two opposite sides of the tongue opposite to the inner and outer ends are two sides, the metal housing and the base seat rest against and are positioned with each other, a connection slot is formed in the four-sided primary housing, the tongue is disposed at a middle height of the connection slot, the docking electric connector can be inserted and positioned into the connection slot in a dual-position bidirectional manner, the metal housing is integrally provided with a reversely bent plate, the reversely bent plate is stacked outside a top surface of the four-sided primary housing, the reversely bent plate integrally extends downwardly to provide at least one first plate connecting member disposed on left and right sides of the four-sided primary housing, and the first plate connecting member can be connected to and positioned on a circuit board.

24. The reversible dual-position electric connector according to claim 23, characterized in that the electric connector satisfies one of (a) to (e) or a combination of more than one of (a) to (e):

(a) wherein the metal housing is formed by bending a metal plate sheet, and the four-sided primary housing is combined and locked together on a plate surface;

(b) wherein the metal housing is formed by bending a metal plate sheet, the four-sided primary housing is combined and locked together on a top plate surface to form a seam, and the reversely bent plate shields the seam;

(c) wherein the metal housing is formed by bending a metal plate sheet, the four-sided primary housing is combined and locked together on a top plate surface to form a seam, and the reversely bent plate shields the seam by more than 85%;

(d) wherein the reversely bent plate is connected to a front end of the four-sided primary housing; and (e) wherein the reversely bent plate is connected to a rear end of the four-sided primary housing.

25. The reversible dual-position electric connector according to claim 1, characterized in that the electric connector satisfies one of (a) to (i) or a combination of more than one of (a) to (i):

(a) wherein the middle of the base seat of the insulated seat is provided with a metal partition plate, and the metal partition plate separates the two terminal sets;

(b) wherein the contacts of the two terminal sets having connection points with the same circuit serial numbers are arranged reversely;

(c) wherein the contacts of the two terminal sets have the same contact interface;

(d) wherein the metal housing is top-bottom symmetrical and left-right symmetrical;

(e) wherein the two terminal sets are fixedly embedded into and injected molded with the insulated seat;

(f) wherein the base seat of the insulated seat is provided with a first base seat and a second base seat directly stacked together, and the two terminal sets are fixedly disposed on the first and second base seats;

(g) wherein the contacts of the two terminal sets are vertically aligned;

(h) wherein the contacts of the two terminal sets are arranged in an equally spaced manner; and (i) wherein the metal housing is formed by bending a metal plate sheet, the four-sided primary housing is combined and locked together on one of the plate surfaces of the four-sided primary housing, and a combination portion forms a gapless combination.

26. The reversible dual-position electric connector according to claim 4, characterized in that the electric connector satisfies one of (a) to (j) or a combination of more than one of (a) to (j):

(a) wherein the middle of the base seat of the insulated seat is provided with a metal partition plate, and the metal partition plate separates the two terminal sets;

(b) wherein the contacts of the two terminal sets having connection points with the same circuit serial numbers are arranged reversely;

(c) wherein the contacts of the two terminal sets have the same contact interface;

(d) wherein the metal housing is top-bottom symmetrical and left-right symmetrical;

(e) wherein the two terminal sets are fixedly embedded into and injected molded with the insulated seat;

(f) wherein the base seat of the insulated seat is provided with a first base seat and a second base seat directly stacked together, and the two terminal sets are fixedly disposed on the first and second base seats;

(g) wherein the contacts of the two terminal sets are vertically aligned;

(h) wherein the contacts of the two terminal sets are arranged in an equally spaced manner;

(i) wherein the metal housing is formed by bending a metal plate sheet, the four-sided primary housing is combined and locked together on a plate surface, the metal plate sheets of the metal housing and the ground shielding member have the same thickness; and (j) wherein the metal housing is formed by bending a metal plate sheet, the four-sided primary housing is combined and locked together on one plate surface, and a combination portion forms a gapless combination.

27. The reversible dual-position electric connector according to claim 5, characterized in that the electric connector satisfies one of (a) to (j) or a combination of more than one of (a) to (j):

(a) wherein the middle of the base seat of the insulated seat is provided with a metal partition plate, and the metal partition plate separates the two terminal sets;

(b) wherein the contacts of the two terminal sets having connection points with the same circuit serial numbers are arranged reversely;

(c) wherein the contacts of the two terminal sets have the same contact interface;

(d) wherein the metal housing is top-bottom symmetrical and left-right symmetrical;

(e) wherein the two terminal sets are fixedly embedded into and injected molded with the insulated seat;

(f) wherein the base seat of the insulated seat is provided with a first base seat and a second base seat directly stacked together, and the two terminal sets are fixedly disposed on the first and second base seats;

(g) wherein the contacts of the two terminal sets are vertically aligned;

(h) wherein the contacts of the two terminal sets are arranged in an equally spaced manner;

(i) wherein the metal housing is formed by bending a metal plate sheet, the four-sided primary housing is combined and locked together on a plate surface, the metal plate sheets of the metal housing and the ground shielding member have the same thickness; and (j) wherein the metal housing is formed by bending a metal plate sheet, the four-sided primary housing is combined and locked together on one plate surface, and a combination portion forms a gapless combination.

28. The reversible dual-position electric connector according to claim 23, characterized in that the electric connector satisfies one of (a) to (i) or a combination of more than one of (a) to (i):

(a) wherein the middle of the base seat of the insulated seat is provided with a metal partition plate, and the metal partition plate separates the two terminal sets;

(b) wherein the contacts of the two terminal sets having connection points with the same circuit serial numbers are arranged reversely;

(c) wherein the contacts of the two terminal sets have the same contact interface;

(d) wherein the metal housing is top-bottom symmetrical and left-right symmetrical;

(e) wherein the two terminal sets are fixedly embedded into and injected molded with the insulated seat;

(f) wherein the base seat of the insulated seat is provided with a first base seat and a second base seat directly stacked together, and the two terminal sets are fixedly disposed on the first and second base seats;

(g) wherein the contacts of the two terminal sets are vertically aligned;

(h) wherein the contacts of the two terminal sets are arranged in an equally spaced manner; and (i) wherein the metal housing is formed by bending a metal plate sheet, the four-sided primary housing is combined and locked together on one plate surface, and a combination portion forms a gapless combination.

* * * * *